US011713778B2

(12) United States Patent
Wang et al.

(10) Patent No.: US 11,713,778 B2
(45) Date of Patent: Aug. 1, 2023

(54) OPTIMIZING MODE TRANSITIONS BETWEEN DUAL POWER ELECTRO-HYDROSTATIC CONTROL SYSTEMS

(71) Applicant: Danfoss Power Solutions II Technology A/S, Nordborg (DK)

(72) Inventors: Meng Wang, Chanhassen, MN (US); Mohd Azrin Mohd Zulkefli, Eden Prairie, MN (US)

(73) Assignee: Danfoss Power Solutions II Technology A/S, Nordborg (DK)

( * ) Notice: Subject to any disclaimer, the term of this patent is extended or adjusted under 35 U.S.C. 154(b) by 50 days.

(21) Appl. No.: 17/613,190

(22) PCT Filed: May 21, 2020

(86) PCT No.: PCT/EP2020/025238

§ 371 (c)(1),
(2) Date: Nov. 22, 2021

(87) PCT Pub. No.: WO2020/239258

PCT Pub. Date: Dec. 3, 2020

(65) Prior Publication Data

US 2022/0307524 A1 Sep. 29, 2022

Related U.S. Application Data

(60) Provisional application No. 62/853,476, filed on May 28, 2019.

(51) Int. Cl.
*F15B 15/18* (2006.01)
*F15B 21/08* (2006.01)

(52) U.S. Cl.
CPC ..... *F15B 15/18* (2013.01); *F15B 21/082* (2013.01); *F15B 2211/20515* (2013.01);
(Continued)

(58) Field of Classification Search
CPC ..... F15B 15/18; F15B 21/082; F15B 2211/20515; F15B 2211/20561;
(Continued)

(56) References Cited

U.S. PATENT DOCUMENTS 5,361,584 A * 11/1994 Langen ..... F16H 61/4157 91/461
9,618,018 B2 * 4/2017 An ..... E02F 9/2228
2012/0260641 A1 * 10/2012 Opdenbosch ..... F15B 7/006 60/470

(Continued)

FOREIGN PATENT DOCUMENTS

EP 2749774 A1 7/2014
EP EP-2808109 A1 * 12/2014 ..... B23B 31/28

(Continued)

OTHER PUBLICATIONS

International Search Report for PCT/EP2020/025238 dated Sep. 15, 2020.

(Continued)

*Primary Examiner* — Thomas E Lazo
(74) *Attorney, Agent, or Firm* — McCormick, Paulding & Huber PLLC

(57) ABSTRACT

The present disclosure relates to a blended or hybrid power system with increased operating efficiency. The blended power system combines the advantages of electrical power with the advantages of hydraulic power when delivering power to a hydraulic actuator. The hydraulic power provides higher power density and the electrical power provides high efficiency and control accuracy in the blended power system. In a blended power system, a control system may be configured to select different modes of operation based on the loads encountered in the combined hydraulic and electrohydrostatic system. The blended power system also allows for smooth and uninterrupted transitions between the different modes of operation within the blended power system. Thus, jerkiness in the blended power system may be minimized or eliminated.

14 Claims, 16 Drawing Sheets

(52) U.S. Cl.
CPC ..... *F15B 2211/20561* (2013.01); *F15B 2211/20569* (2013.01); *F15B 2211/27* (2013.01); *F15B 2211/3057* (2013.01); *F15B 2211/613* (2013.01); *F15B 2211/6313* (2013.01); *F15B 2211/6658* (2013.01)

(58) Field of Classification Search
CPC ..... F15B 2211/3057; F15B 2211/613; F15B 2211/6658; F15B 2013/0412
See application file for complete search history.

(56) References Cited

U.S. PATENT DOCUMENTS

| | | | | |
|---|---|---|---|---|
| 2015/0121860 | A1* | 5/2015 | Hyon | F15B 13/021 60/459 |
| 2017/0184139 | A1* | 6/2017 | Bhaskar | E02F 9/2289 |
| 2018/0266447 | A1* | 9/2018 | Imam | F15B 7/10 |
| 2020/0256353 | A1* | 8/2020 | Costa | F15B 7/006 |

FOREIGN PATENT DOCUMENTS

| | | | |
|---|---|---|---|
| EP | 3 158 205 | A1 | 4/2017 |
| WO | 2005/024246 | A1 | 3/2005 |
| WO | 2015/195246 | A1 | 12/2015 |
| WO | 2019051582 | A1 | 3/2019 |

OTHER PUBLICATIONS

Extended European Search Report for European Patent Application No. 22185644.6 dated Nov. 7, 2022.

* cited by examiner

Q1.dual-EHA

Q2.dual-EHA

Q3.dual-EHA

Q4.dual-EHA

Q3.EHA

Q4.EHA

OPTIMIZING MODE TRANSITIONS BETWEEN DUAL POWER ELECTRO-HYDROSTATIC CONTROL SYSTEMS

CROSS-REFERENCE TO RELATED APPLICATION

This application is a National Stage application of International Patent Application No. PCT/EP2020/025238, filed on May 21, 2020, which claims priority to U.S. Application No. 62/853,476 filed on May 28, 2019, each of which is hereby incorporated by reference in its entirety.

TECHNICAL FIELD

The disclosure relates to hydraulic actuators, and more particularly to the control of dual power electro-hydrostatic actuators.

BACKGROUND

Electro-hydrostatic actuators (EHAs) replace hydraulic systems with self-contained actuators operated solely by electrical power. An EHA system may include an extendable hydraulic linear actuator having a cylinder and a piston, a hydraulic pump, and an electric motor. The hydraulic system may be for extending and retracting a hydraulic linear actuator in a work machine, such as but not limited to hydraulic excavators, loading shovels, backhoe shovels, mining equipment, industrial machinery and the like, having one or more actuated components such as lifting and/or tilting arms, booms, buckets, steering and turning functions, etc.

EHAs have been utilized for low power, stationary applications. When it comes to higher power applications, such as off-highway (i.e., off-road) vehicles, the current state-of-the-art technology has not provided a cost effective and energy efficient solution.

SUMMARY

Aspects of the present disclosure relate to increasing operating efficiency in a blended or hybrid power system. The blended power system combines the advantages of electrical power with the advantages of hydraulic power when delivering power to a hydraulic actuator. The hydraulic power provides higher power density and the electrical power provides high efficiency and control accuracy in the blended power system. In a blended power system, a control system may be configured to select different modes of operation based on the loads encountered in the combined hydraulic I and electro-hydrostatic system. The blended power system also allows for smooth and uninterrupted transitions between the different modes of operation within the blended power system. Thus, jerkiness in the blended power system may be minimized or eliminated.

One aspect of the disclosure relates to a hydraulic system that may include a bi-directional hydraulic pump that has a first pump port and a second pump port. The hydraulic system may include an electric motor/generator mechanically coupled to the bi-directional hydraulic pump and a hydraulic pressure source. The hydraulic system may also include a first actuator port; a second actuator port; and a valve arrangement configured for operating the hydraulic system in a plurality of modes. The hydraulic system may further include a control system for coordinating operation of the valve arrangement.

In certain examples, one of the plurality of modes may include a first combined hydraulic and electro-hydrostatic mode in which: a) the first pump port is fluidly connected to the first actuator port; b) the second pump port is fluidly connected to the hydraulic pressure source; and c) the second actuator port is fluidly connected to tank.

In certain examples, one of the plurality of modes may include a second combined hydraulic and electro-hydrostatic mode in which: a) the first pump port is fluidly connected to the hydraulic pressure source; b) the second pump port is fluidly connected to the second actuator port; and c) the first actuator port is fluidly connected to tank.

In certain examples, one of the plurality of modes may include a load-holding mode in which: a) the hydraulic pressure source is connected to the first and second pump ports; b) the first and second actuator ports are disconnected from the first and second pump ports; and c) hydraulic fluid flow through the first and second actuator ports is locked.

In certain examples, one of the plurality of modes may include an electro-hydrostatic mode in which the hydraulic pressure source is disconnected from the first and second pump ports, and a closed hydraulic circuit is defined between the hydraulic pump and the first and second actuator ports.

The control system may have a transition control protocol used for transitioning the hydraulic system between two different modes. A first of the two different modes may include one of the first combined hydraulic and electro-hydrostatic mode, the second combined hydraulic and electro-hydrostatic mode or the load-holding mode. A second of the two different modes may include one of the first combined hydraulic and electro-hydrostatic mode, the second combined hydraulic and electro-hydrostatic mode or the load-holding mode.

In certain examples, the transition control protocol includes operating the hydraulic system temporarily in the electro-hydrostatic mode as an intermediate step that takes place as the hydraulic system is transitioned between the first and second different modes.

The hydraulic system may include a first hydraulic flow path for fluidly connecting the hydraulic pressure source to the first pump port. A first valve may be positioned along the first hydraulic flow path for opening the first hydraulic flow path such that fluid communication is provided between the first pump port and the hydraulic pressure source and for closing the first hydraulic flow path such that fluid communication is blocked between the hydraulic pressure source and the first pump port.

The hydraulic system may also include a second hydraulic flow path for fluidly connecting the hydraulic pressure source to the second pump port. A second valve may be positioned along the second hydraulic flow path for opening the second hydraulic flow path such that fluid communication is provided between the second pump port and the hydraulic pressure source and for closing the second hydraulic flow path such that fluid communication is blocked between the hydraulic pressure source and the second pump port.

The hydraulic system may also include a third hydraulic flow path for fluidly connecting the first pump port to the first actuator port. A third valve may be positioned along the third hydraulic flow path. The third valve may have a first valve position in which the third hydraulic flow path is open between the first actuator port and the first pump port, a second valve position in which the third hydraulic flow path is blocked and flow through a portion of the third hydraulic flow path located between the third valve and the first actuator port is hydraulically locked, and a third valve position in which fluid communication between the first pump port and the first actuator port through the third hydraulic flow path is interrupted and the first actuator port is fluidly connected to tank.

The hydraulic system may further include a fourth hydraulic flow path for fluidly connecting the second pump port to the second actuator port. A fourth valve may be positioned along the fourth hydraulic flow path. The fourth valve may have a first valve position in which the fourth hydraulic flow path is open between the second actuator port and the second pump port, a second valve position in which the fourth hydraulic flow path is blocked and flow through a portion of the fourth hydraulic flow path located between the fourth valve and the second actuator port is hydraulically locked, and a third valve position in which fluid communication between the second pump port and the second actuator port through the fourth hydraulic flow path is interrupted and the second actuator port is fluidly connected to tank.

In certain examples, the hydraulic system may include a pump charge circuit for providing pump charge flow to the third and fourth hydraulic flow paths.

A variety of additional aspects will be set forth in the description that follows. The aspects relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Aspects of the present disclosure will be described more fully hereinafter with reference to the accompanying drawings, in which illustrative embodiments are shown. This disclosure may, however, be embodied in many different forms and should not be construed as limited to the embodiments set forth herein; rather, these embodiments are provided so that this disclosure will be thorough and complete, and will fully convey the scope of the invention to those skilled in the art.

Figure 1:
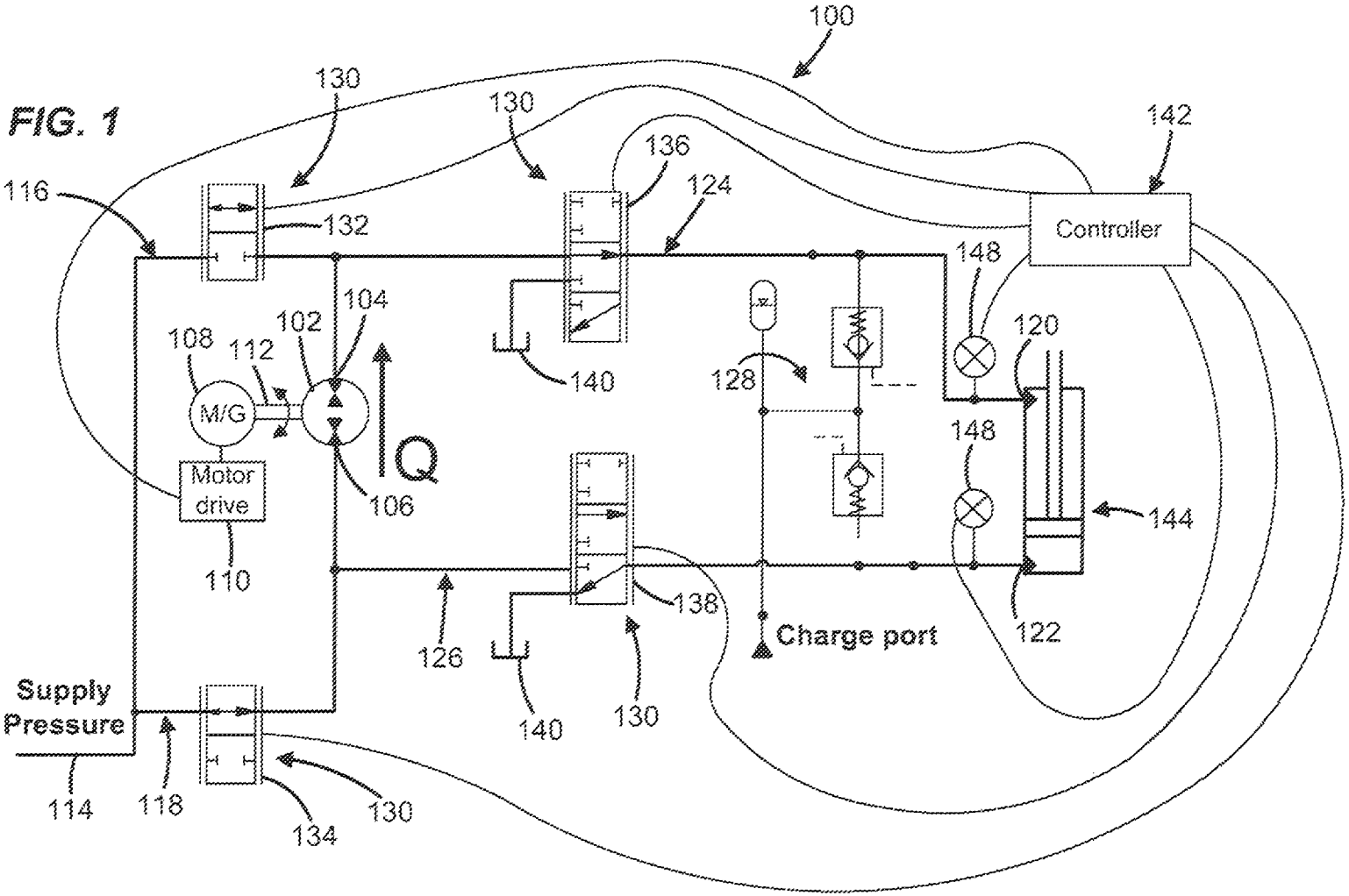
FIG. 1 schematically depicts a dual power electro hydrostatic hydraulic actuation system in accordance with principles of the present disclosure for powering an actuator.

FIG. 1 is a schematic representation of an example hydraulic actuation system 100 in accordance with the principles of the present disclosure. The hydraulic actuation system 100 may include a bi-directional hydraulic pump 102 that has a first pump port 104 and a second pump port 106. The hydraulic actuation system 100 may also include an electric motor/generator 108. In one example, the electric motor/generator 108 is a servo electric motor/generator. The electric motor/generator 108 includes a motor drive 110 that may be coupled to an electrical power source (not shown). The electric motor/generator 108 may be mechanically coupled to the bi-directional hydraulic pump 102 by a drive shaft 112.

The hydraulic actuation system 100 may also include a hydraulic pressure source 114. In certain examples, the hydraulic pressure source 114 includes a common pressure rail. The common pressure rail can be pressurized by a hydraulic pump or the like and can include a hydraulic accumulator for storing and/or supplying hydraulic pressure as needed.

The hydraulic actuation system 100 may include a first hydraulic flow path 116 for fluidly connecting the hydraulic pressure source 114 to the first pump port 104, and a second hydraulic flow path 118 for fluidly connecting the hydraulic pressure source 114 to the second pump port 106.

The hydraulic actuation system 100 may further include a first actuator port 120 and a second actuator port 122. A third hydraulic flow path 124 may be provided in the hydraulic actuation system 100 for fluidly connecting the first pump port 104 to the first actuator port 120. A fourth hydraulic flow path 126 may be provided in the hydraulic actuation system 100 for fluidly connecting the second pump port 106 to the second actuator port 122. The hydraulic actuation system 100 may include a pump charge circuit 128 for providing pump charge flow to the third and fourth hydraulic flow paths 124, 126.

A valve arrangement 130 may be configured in the hydraulic actuation system 100 for operating the hydraulic actuation system 100 in a plurality of modes. In certain examples, the valve arrangement 130 may include a first valve 132, a second valve 134, a third valve 136, and a fourth valve 138. In certain examples, the first and second valves 132, 134 may include a two position spool valve. In certain examples, the third and fourth valves 136, 138 may include a three position spool valve. It will be appreciated that the first, second, third, and fourth valves 132, 134, 136, 138 can each be moved between different positions by a corresponding actuator such as a solenoid or a voice coil actuator, and/or can have movement which is spring and/or pilot assisted. The first and second valves 132, 134 may be separate valves that are independently movable relative to one another. The third and fourth valves 136, 138 may be separate valves that are independently movable relative to one another.

As used herein, independent valve movement may be defined as valves that have the capability of being moved independently with respect to each other. For example, a first valve may remain stationary while a second valve may be moved and vice versa. Independent valve movement may also include examples where movement of the valves, for example sequenced movement, may be coordinated by a controller.

The first valve 132 may be positioned along the first hydraulic flow path 116 for opening the first hydraulic flow path 116 such that fluid communication is provided between the first pump port 104 and the hydraulic pressure source 114. The first valve 132 may also be configured for closing the first hydraulic flow path 116 such that fluid communication is blocked between the hydraulic pressure source 114 and the first pump port 104.

The second valve 134 may be positioned along the second hydraulic flow path 118 for opening the second hydraulic flow path 118 such that fluid communication is provided between the second pump port 106 and the hydraulic pressure source 114. The second valve 134 may also be configured for closing the second hydraulic flow path 118 such that fluid communication is blocked between the hydraulic pressure source 114 and the second pump port 106.

The third valve 136 may be positioned along the third hydraulic flow path 124. In the example depicted in FIG. 1, the third valve 136 is in a first valve position in which the third hydraulic flow path 124 is open between the first actuator port 120 and the first pump port 104.

In other examples, the third valve 136 may be positioned in a second valve position in which the third hydraulic flow path 124 is blocked and flow through a portion of the third hydraulic flow path 124 located between the third valve 136 and the first actuator port 120 is hydraulically locked.

Figure 5:
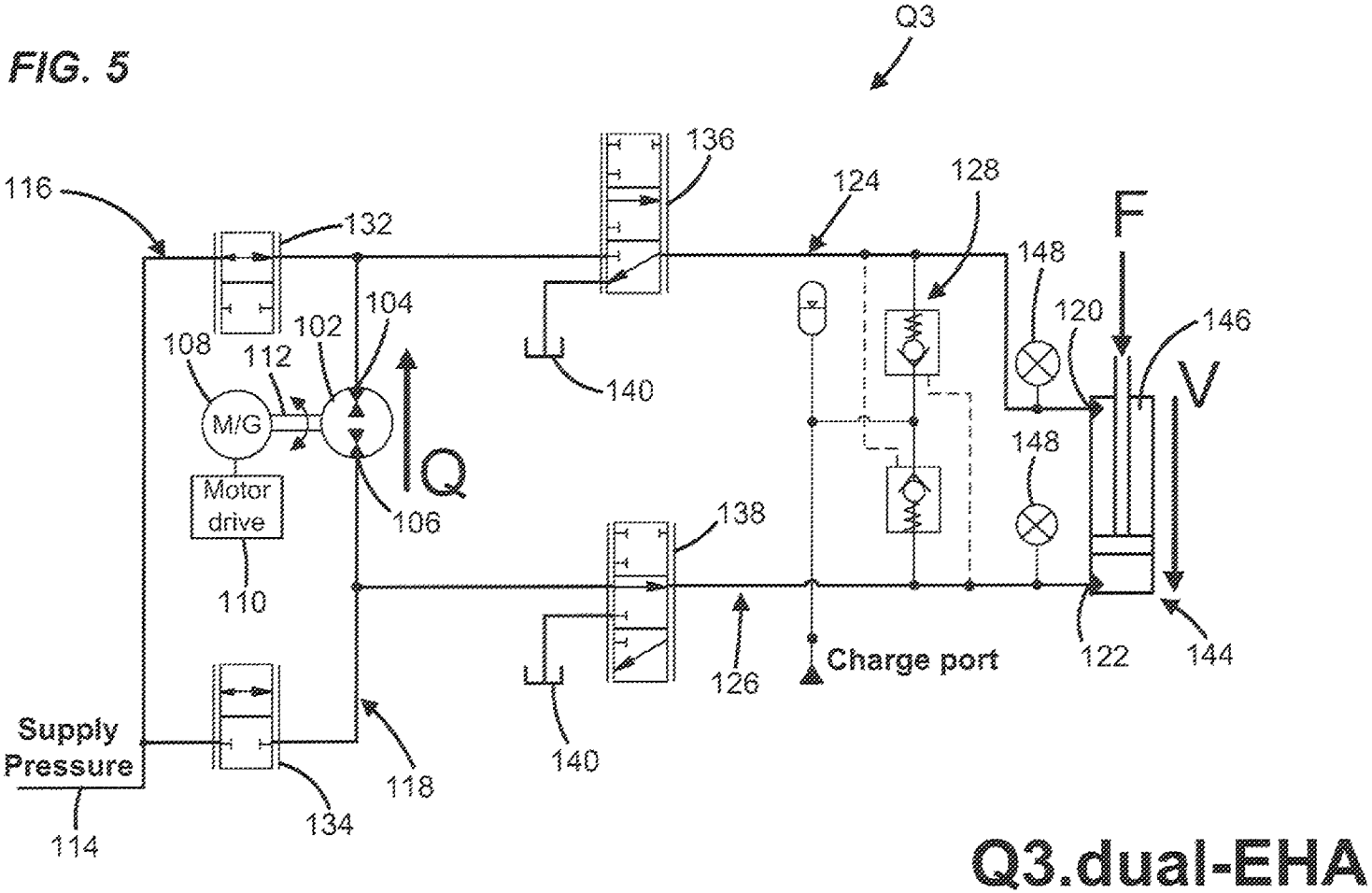
FIG. 5 schematically depicts the hydraulic actuation system of FIG. 2 operating in a second over-running operating condition corresponding to third quadrant operation.

In still other examples, the third valve 136 may be configured in a third valve position in which fluid communication between the first pump port 104 and the first actuator port 120 through the third hydraulic flow path 124 is interrupted and the first actuator port 120 is fluidly connected to tank 140 (see FIG. 5).

The fourth valve 138 may be positioned along the fourth hydraulic flow path 126. The fourth valve 138 may have a first valve position in which the fourth hydraulic flow path 126 is open between the second actuator port 122 and the second pump port 106, a second valve position in which the fourth hydraulic flow path 126 is blocked and flow through a portion of the fourth hydraulic flow path 126 located between the fourth valve 138 and the second actuator port 122 is hydraulically locked, and a third valve position in which fluid communication between the second pump port 106 and the second actuator port 122 through the fourth hydraulic flow path 126 is interrupted and the second actuator port 122 is fluidly connected to tank 140. FIG. 1 depicts the fourth valve 138 in the third valve position.

The hydraulic actuation system 100 may include a control system 142 for coordinating operation of the valve arrangement 130. The control system 142 may have a transition control protocol used for transitioning the hydraulic actuation system 100 between two different modes. In low power applications, the control system 142 may select a single EHA mode operation and when a higher load application is encountered, the control system 142 may select the dual EHA mode operation.

The control system 142 may include a controller or controllers that each have one or more processors. The processors can interface with software, firmware, and/or hardware. Additionally, the processors can include digital analog processing capabilities and can interface with memory (e.g., random access memory, read-only memory, or other data storage). In certain examples, the processors can include a programmable logic controller, one or more microprocessors, or like structures.

Figure 2:
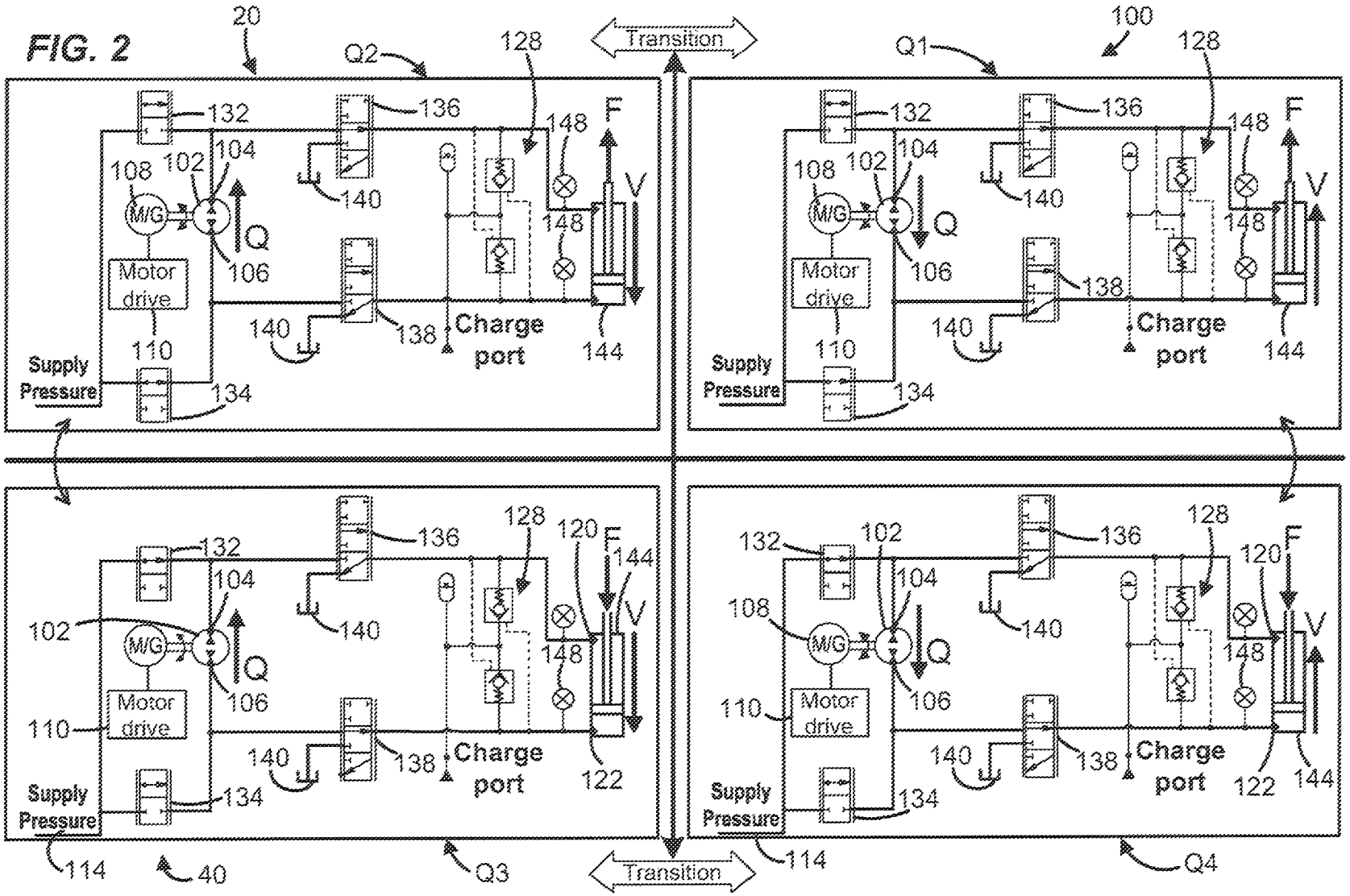
FIG. 2 schematically depicts four quadrants of operations for the hydraulic actuation system in accordance with the principles of the present disclosure.

FIG. 2 schematically illustrates four-quadrant operations Q1-Q4 of a dual power electro-hydrostatic actuator 144 in accordance with the principles of the present disclosure. The actuator 144 may be depicted as a hydraulic cylinder. Transitioning between the various quadrants of operation can be controlled by the control system 142. The operating mode may be selected based on the power/force conditions in the hydraulic actuation system 100. The four-quadrant operations refer to actuator extension or retraction under passive or overrunning loads, which is described in further detail below.

The valve arrangement 130 may be configured for operating the hydraulic actuation system 100 in a plurality of operating modes. The plurality of operating modes may include a first combined hydraulic and electro-hydrostatic mode 20 (see FIG. 3 and FIG. 4) in which: a) the first pump port 104 is fluidly connected or coupled to (i.e., in fluid communication with) the first actuator port 120; b) the second pump port 106 is fluidly connected or coupled to the hydraulic pressure source 114; and c) the second actuator port 122 is fluidly connected or coupled to tank 140.

The plurality of operating modes may also include a second combined hydraulic and electro-hydrostatic mode 40 (see FIG. 5 and FIG. 6) in which: a) the first pump port 104 is fluidly connected or coupled to the hydraulic pressure source 114; b) the second pump port 106 is fluidly connected or coupled to the second actuator port 122; and c) the first actuator port 120 is fluidly connected or coupled to tank 140.

The plurality of operating modes may further include a load-holding mode 60 (see FIG. 8) in which: a) the hydraulic pressure source 114 is connected to the first and second pump ports 104, 106; b) the first and second actuator ports 120, 122 are disconnected from the first and second pump ports 104, 106; and c) hydraulic fluid flow through the first and second actuator ports 120, 122 is locked.

The plurality of operating modes may include an electro-hydrostatic mode 80 (see FIG. 9) in which the hydraulic pressure source 114 is disconnected from the first and second pump ports 104, 106, and a closed hydraulic circuit is defined between the bi-directional hydraulic pump 102 and the first and second actuator ports 120, 122. Each one of the plurality of operating modes will be described in further detail with reference to FIGS. 3-6.

The control system 142 may be configured to sense a load transition condition. The load transition condition may be a condition in which a load applied to the actuator 144 fluidly coupled to the first and second actuator ports 120, 122 is transitioning from a passive state to an over-running state and vice versa. The four-quadrant operations Q1-Q4 of a dual power electro-hydrostatic actuator 144 depicted in FIG. 2 illustrate the transition between a passive state and an over-running state. Each quadrant is described herein.

Figure 3:
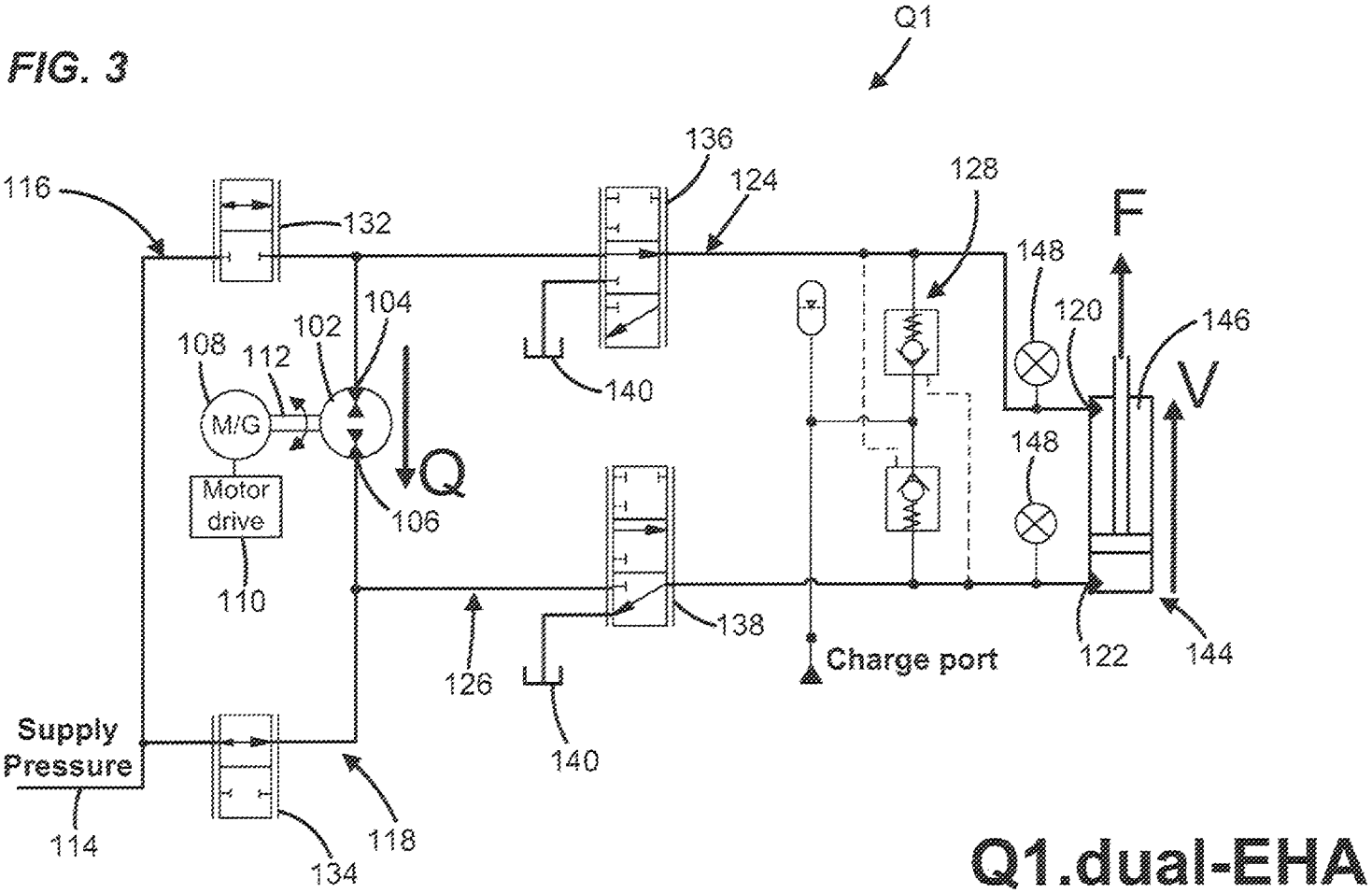
FIG. 3 schematically depicts the hydraulic actuation system of FIG. 2 operating in a first over-running operating condition corresponding to first quadrant operation.

FIG. 3 schematically illustrates the first quadrant QI in which the hydraulic actuation system I 00 is operating in the first combined hydraulic and electro-hydrostatic mode 20 and the actuator load is in an over-running condition. When the hydraulic actuation system I 00 is in this mode, fluid from the actuator 144 may be directed through the third hydraulic flow path 124 to the bi-directional hydraulic pump I 02 thereby driving the bi-directional hydraulic pump I02 as a hydraulic motor. The actuator 144 is indicated with different sign conventions. The arrow labeled F represents the direction that load is being applied to the rod of the actuator 144. The arrow labeled V represents the direction of movement of the piston rod of the actuator 144 relative to the actuator body of the actuator 144. An upward direction of the velocity arrow V represents a positive direction while a downward direction of the velocity arrow V represents a negative direction.

Still referring to FIG. 3, the arrow F is directed in an upward direction to indicate that the load corresponds to a positive force value. Likewise, the velocity arrow V is directed in an upward direction. That is, the first quadrant QI of FIG. 2 represents an operational condition in which the velocity V of the piston rod and the load force F acting on the piston rod are both in a positive direction. This represent an overrunning condition in which the actuator 144 is extending and a rod side 146 of the actuator 144 is the load holding side of the actuator 144.

When the hydraulic actuation system I00 is operating in the first quadrant QI, energy from a load is directed from the actuator 144 back to the bi-directional hydraulic pump I 02 where energy is captured for re-use. In this condition, the force of the load applied to the piston rod drives hydraulic fluid flow from the rod side 146 of the actuator 144 back through the third valve 136 to the bi-directional hydraulic pump 102 to drive movement of the bi-directional hydraulic pump 102. As such, the third valve 136 is in the first valve position in which the third hydraulic flow path 124 is open between the first actuator port 120 and the first pump port 104. That is, energy corresponding to the hydraulic fluid flow Q from the actuator 144 can be captured by an accumulator at the hydraulic pressure source 114 and/or can be used to drive the electric motor/generator 108 through the drive shaft 112 thereby causing electricity to be generated which can be stored at a battery corresponding to an electrical power source (not shown).

Figure 4:
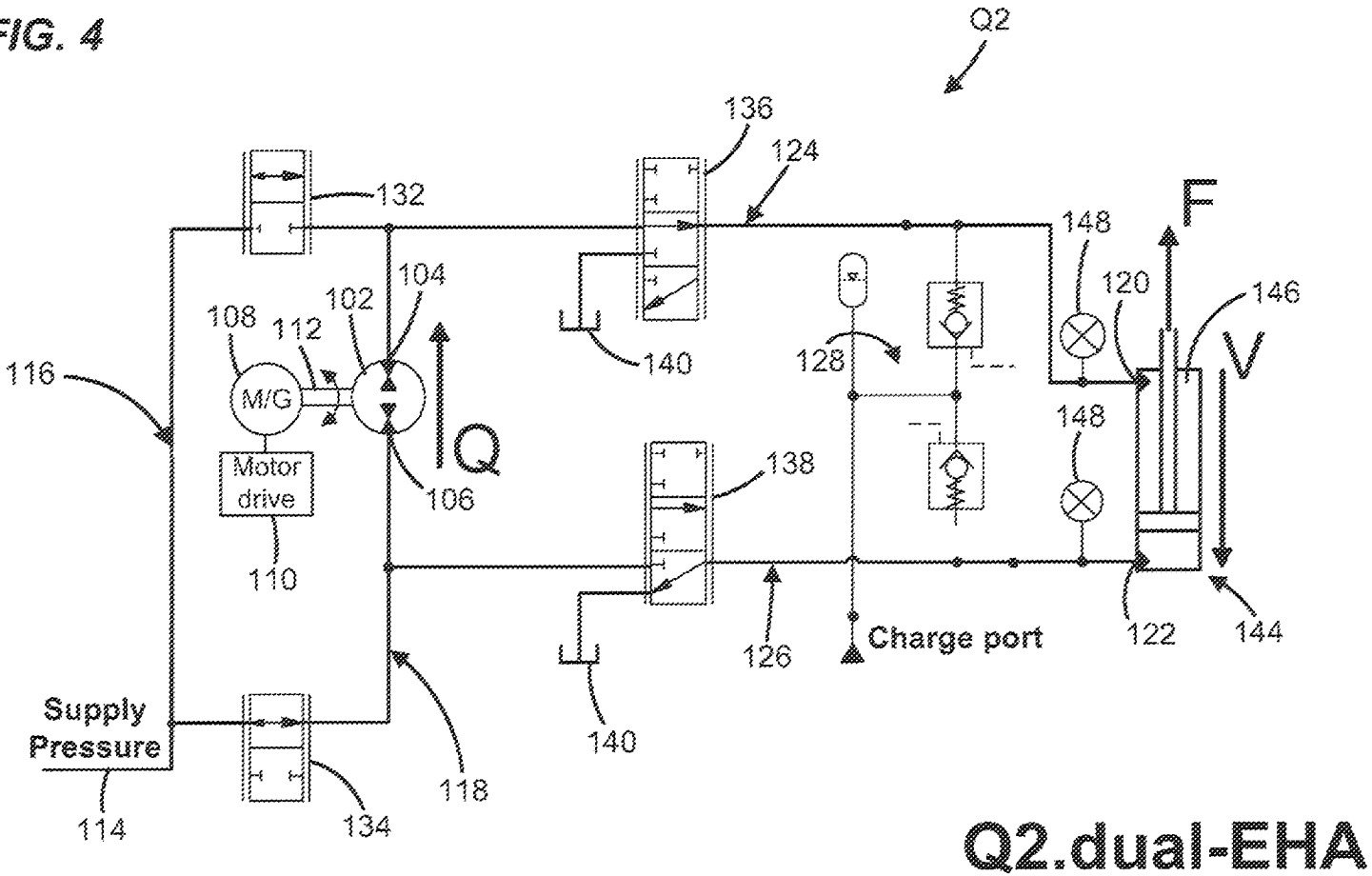
FIG. 4 schematically depicts the hydraulic actuation system of FIG. 2 operating in a first passive operating condition corresponding to second quadrant operation.

Turning to FIG. 4, a second quadrant Q2 operation of the four different quadrants of operation depicted in FIG. 2 is illustrated. The second quadrant Q2 is a passive operating condition in which the actuator 144 is retracting and the rod side 146 of the actuator 144 is the load-holding side of the actuator 144. The arrow F is directed in an upward direction and the velocity arrow V is directed in a downward direction.

That is, the second quadrant Q2 of FIG. 4 represents an operational condition in which the load force F acting on the piston rod of the actuator 144 is positive and the velocity V of the piston rod is negative. In this condition, hydraulic energy is directed from the bi-directional hydraulic pump 102 to the actuator 144 to drive movement of the load. When accommodating second quadrant operation, hydraulic power directed through the bi-directional hydraulic pump 102 from the hydraulic pressure source 114 can be directed to the rod side 146 of the actuator 144 and used to drive downward movement of the piston rod against the load force F applied to the piston rod. In the operating condition of FIG. 4, the first hydraulic flow path 116 is closed, the second hydraulic flow path 118 is open, the third valve 136 is in the first valve position in which the third hydraulic flow path 124 is open between the first actuator port 120 and the first pump port 104 and the fourth valve 138 is in the third valve position in which fluid communication between the second pump port 106 and the second actuator port 122 through the fourth hydraulic flow path 126 is interrupted and the second actuator port 122 is fluidly connected to tank 140.

In the operating condition of FIG. 4, the electric motor/generator 108 and the hydraulic pressure source 114 cooperate to cause the bi-directional hydraulic pump 102 to direct hydraulic fluid to the first actuator port 120. Power for driving movement of the actuator 144 can be provided by the hydraulic pressure source 114 coupled to the second pump port 106 of the bi-directional hydraulic pump 102 by an electrical power source which drives the electric motor/generator 108 coupled to the bi-directional hydraulic pump 102; or by blended power provided by both hydraulic power source coupled to the second pump port 106 and the electrical power source which drives the electric motor/generator 108 coupled to the bi-directional hydraulic pump 102 by the drive shaft 112.

Depending upon the magnitude of power required to drive movement of the piston rod (i.e., the differential pressure required between the rod side 146 of the actuator 144 and the pressure provided by the hydraulic pressure source 114), the electric motor/generator 108 can either be operated as a generator which extracts energy from the bi-directional hydraulic pump 102 through the drive shaft 112 and stores the extracted energy at a battery for later use, or can be operated as a motor in which energy is transferred to the bi-directional hydraulic pump 102 through the drive shaft 112 to provide a boost of hydraulic pressure/flow to the actuator 144.

It will be appreciated that when the electric motor/generator 108 is operated as a motor, blended power (e.g., power derived from the electrical power source and the hydraulic power source) is used to drive the actuator 144. It will be appreciated that when the electric motor/generator 108 is operated as a generator, the hydraulic pressure source 114 drives movement of the actuator 144 and the motor/generator captures excess power provided by the hydraulic pressure source 114 that is not needed to drive the actuator 144.

Turning to FIG. 5, a third quadrant Q3 is schematically illustrated in which the hydraulic actuation system 100 is operating in the second combined hydraulic and electro-hydrostatic mode 40 and the actuator load is in an over-running condition. In the second combined hydraulic and electro-hydrostatic mode 40, the second hydraulic flow path 118 is closed, the first hydraulic flow path 116 is open, the third valve 136 is in the third valve position in which fluid communication between the first pump port 104 and the first actuator port 120 through the third hydraulic flow path 124 is interrupted and the first actuator port 120 is fluidly connected to tank 140, and the fourth valve 138 is in the first valve position in which the fourth hydraulic flow path 126 is open between the second actuator port 122 and the second pump port 106. In this over-running condition, energy can be transferred from the actuator 144 back to the bi-directional hydraulic pump 102. Such power can be recaptured by means such as an accumulator at the hydraulic pressure source 114 and/or by operating the electric motor/generator 108 as a generator such that the hydraulic energy transferred from the actuator 144 can be converted to electrical energy which can be stored at a battery, capacitor or other structure.

Figure 6:
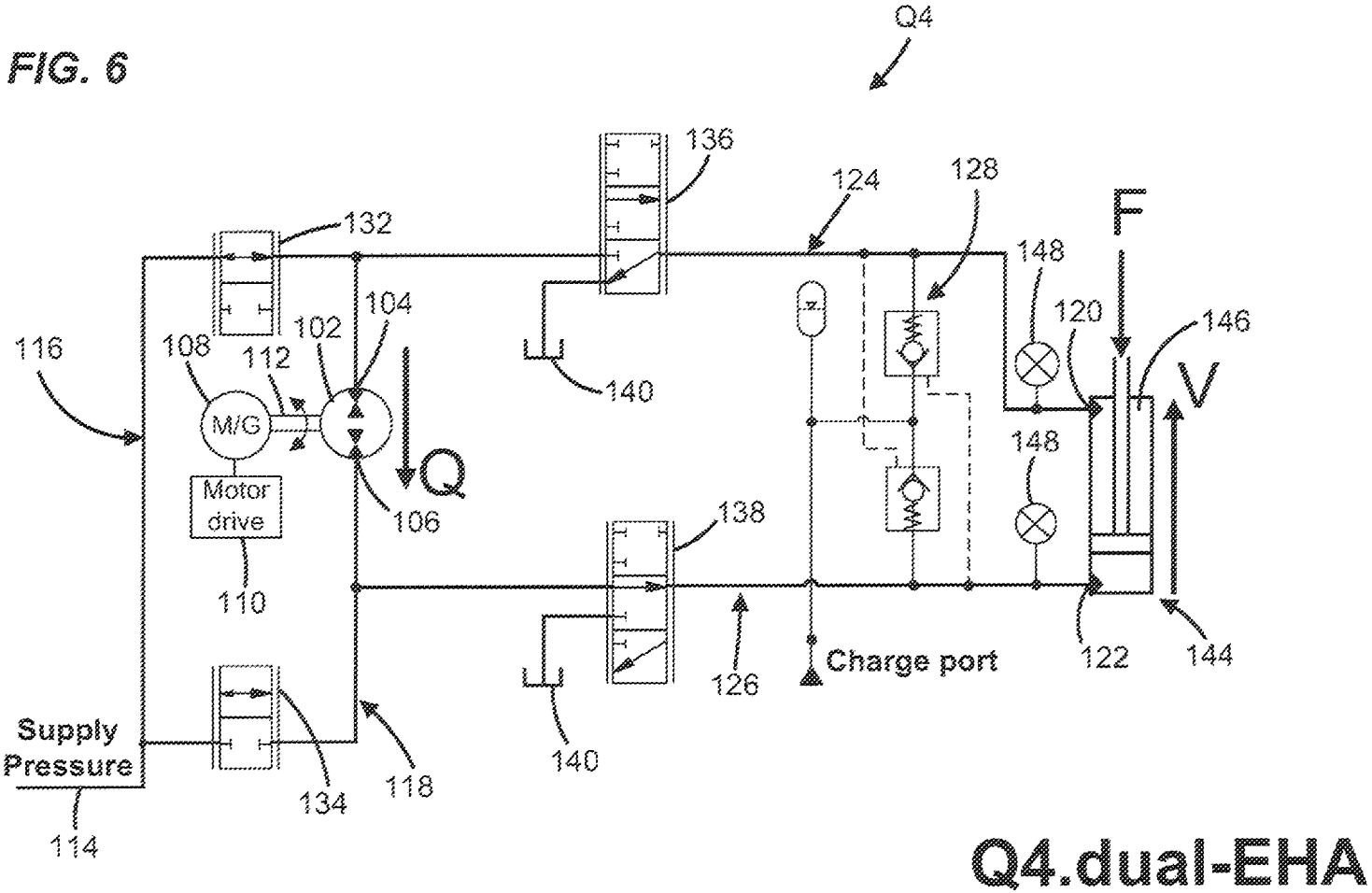
FIG. 6 schematically depicts the hydraulic actuation system of FIG. 2 operating in a second passive operating condition corresponding to fourth quadrant operation.

FIG. 6 illustrates the hydraulic actuation system 100 operating according to a fourth quadrant Q4 operation in which the direction of movement of the piston rod of the actuator 144 is opposite as compared to the load forced direction (e.g., the actuator 144 is extending with the piston moving upward against a downward load force F). The fourth quadrant Q4 is a passive operating condition in which the actuator 144 is retracting and the rod side 146 of the actuator 144 is the load-holding side of the actuator 144. The arrow F is directed in a downward direction and the velocity arrow V is directed in an upward direction. That is, the fourth quadrant Q4 of FIG. 6 represents an operational condition in which the load force F acting on the piston rod of the actuator 144 is negative and the velocity V of the piston rod is positive. The piston rod is driven in an upward direction and the load force applied to the piston rod by the load is in a downward direction. It will be appreciated that power for driving movement of the actuator 144 can be provided by the hydraulic pressure source 114, by the electric motor/generator 108, or through blended power provided by both the hydraulic pressure source 114 and the electric motor/generator 108. For example, power for driving the actuator 144 can be provided by pressurized hydraulic fluid from the hydraulic pressure source 114 which is directed through the bi-directional hydraulic pump 102. The power directed through the bi-directional hydraulic pump 102 can be boosted as needed by operating the electric motor/generator 108 as a motor via power from an electrical power source, or can be reduced as needed by operating the electric motor/generator 108 as a generator which taps power from the bi-directional hydraulic pump 102 and directs the tapped power back to the electrical power source.

The control system 142 can be configured to coordinate operation of the first valve 132, the second valve 134, the third valve 136, the fourth valve 138, the bi-directional hydraulic pump 102, and the electric motor/generator 108.

The control system 142 may have a transition control protocol for transitioning the hydraulic actuation system I 00 between two different modes where a first of the two different modes includes one of the first combined hydraulic and electro-hydrostatic mode, the second combined hydraulic and electro-hydrostatic mode or the load-holding mode. A second of the two different modes includes one of the first combined hydraulic and electro-hydrostatic mode the second combined hydraulic and electro-hydrostatic mode or the load-holding mode.

The transition control protocol may include operating the hydraulic actuation system I 00 temporarily in the electro-hydrostatic mode as an intermediate step that takes place as the hydraulic actuation system I 00 is transitioned from one of the first and second combined hydraulic and electro-hydrostatic modes to the other of the first and second combined hydraulic and electro-hydrostatic modes.

The hydraulic actuation system I 00 may further include pressure sensors 148 (see FIG. 1) for sensing pressures corresponding to the first and second actuator ports 120, 122. The control system 142 uses the sensed pressures to determine when a load transition condition is occurring. When a load transition condition occurs, the high pressure side and the low pressure side of the actuator 144 equalize and then switch. The control system 142 will recognize the pressures sensed as a result of the pressure sensors 148 equalizing and then switching. That is, before the load transition occurs, the hydraulic actuation system I 00 can be operated with a first pressure P1 at one side of the actuator 144 being greater than a second pressure P2 at the opposite side of the actuator 144. As the load transition condition begins to occur, the values of the first pressure P1 and the second pressure P2 converge. After the load transition has occurred, the hydraulic actuation system I 00 can be operated with the second pressure P2 being greater than the first pressure P1.

Figure 7:
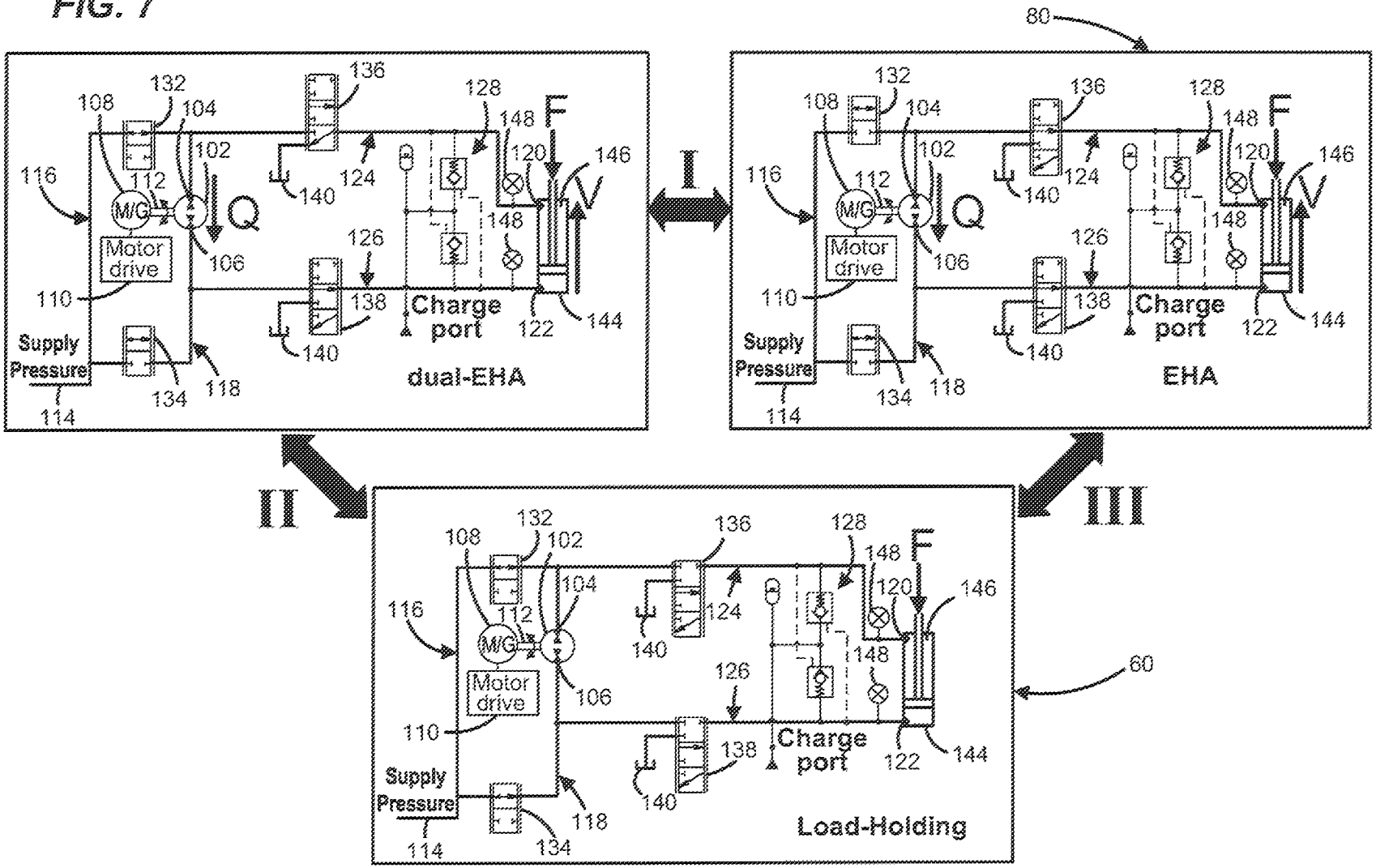
FIG. 7 schematically depicts three modes of operations for the hydraulic actuation system of FIG. 2.

FIG. 7 schematically depicts the dual power electro-hydrostatic actuator (dEHA) with three operating modes. The first operating mode is the dual power mode (dual-EHA) in which the hydraulic power and the electric power are combined before they are delivered to the actuator 144. The second operating mode is the EHA mode in which all power delivered to the actuator 144 is originally from an electrical power source. The third operating mode is a load holding mode in which the actuator 144 is stationary with a load. A switching sequence can occur between the three operating modes as indicated by the arrows generally referenced as arrows I, II, III. That is, a switching sequence can occur as follows: I) dual-EHA to/from EHA, II) dual-EHA to/from Load-Holding, and III) EHA to/from Load-Holding.

Figure 8:
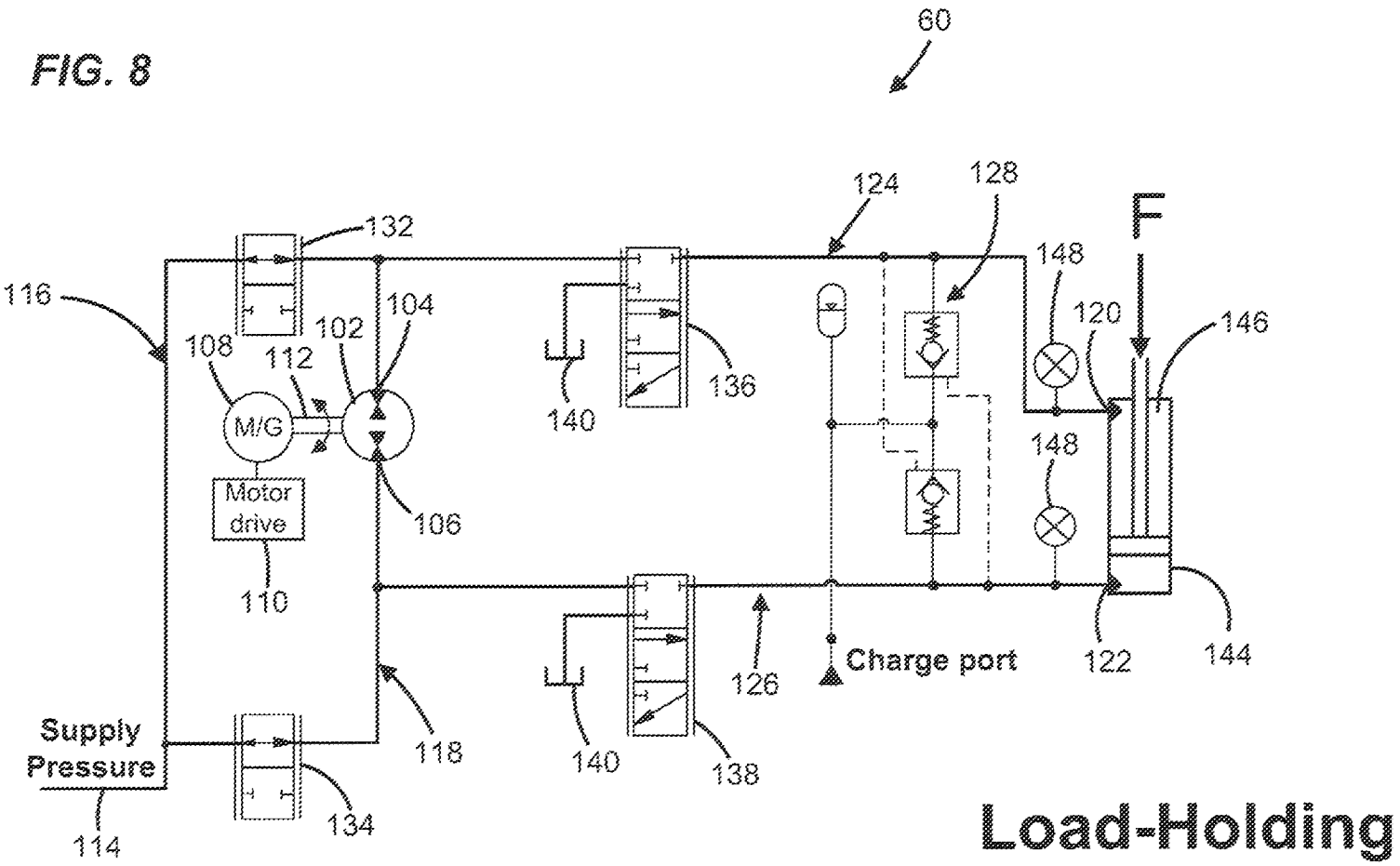
FIG. 8 schematically depicts the hydraulic actuation system of FIG. 2 operating in a load-holding mode.

FIG. 8 schematically illustrates the load-holding mode shown in FIG. 7. The hydraulic actuation system 100 can provide a load-holding mode to handle stationary load encountered by the actuator 144. When the hydraulic actuation system 100 is operating in the load-holding mode, the first and second hydraulic flow paths 116, 118 are open and the third and fourth valves 136, 138 are in the second valve position. In the second valve position, the third hydraulic flow path 124 is blocked and flow through a portion of the third hydraulic flow path 124 located between the third valve 136 and the first actuator port 120 is hydraulically locked and the fourth hydraulic flow path 126 is blocked and flow through a portion of the fourth hydraulic flow path 126 located between the fourth valve 138 and the second actuator port 122 is hydraulically locked. Thus, the load is held by both the third and fourth valves 136, 138.

Figure 9:
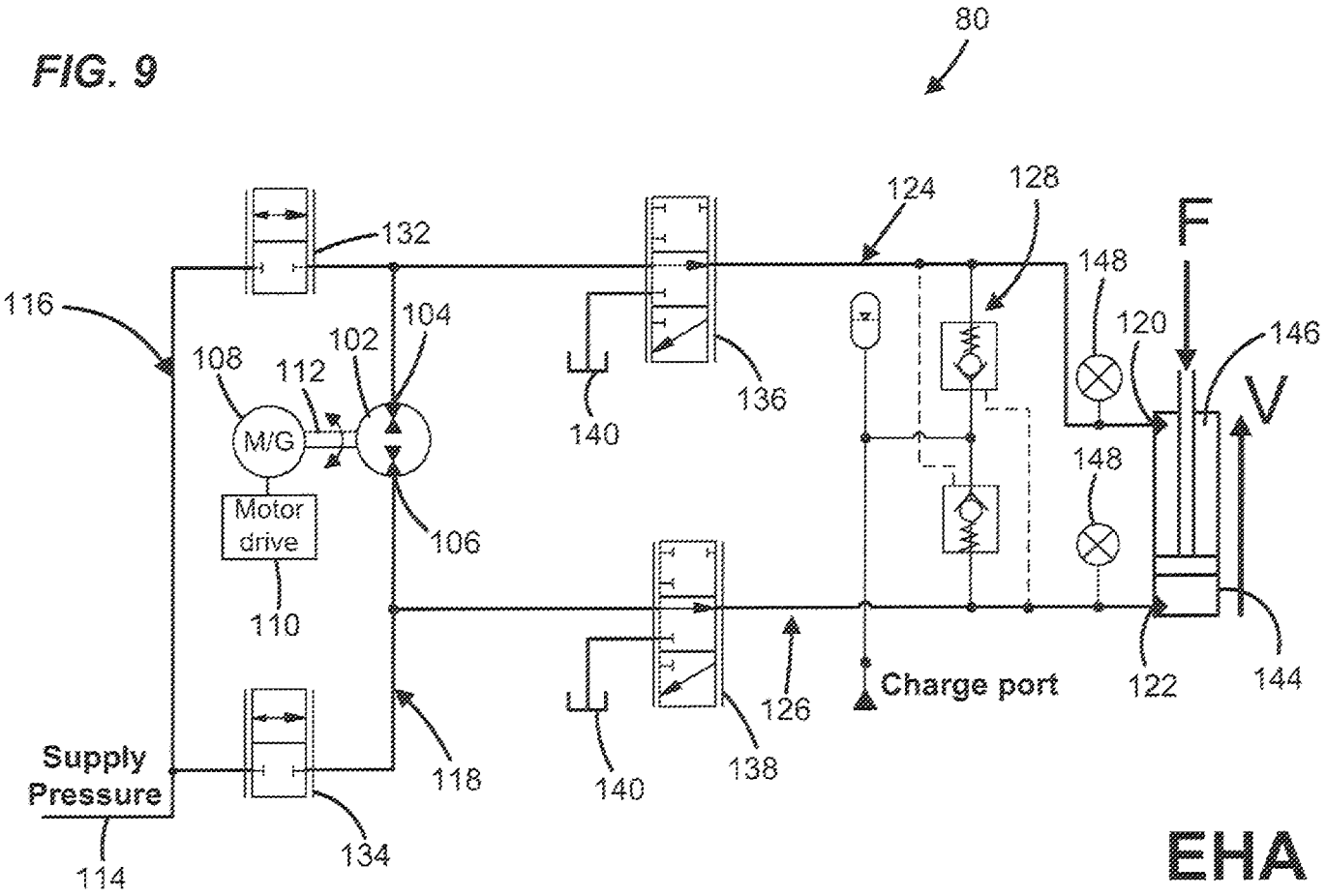
FIG. 9 schematically depicts the hydraulic actuation system of FIG. 2 operating in an electro-hydraulic mode in which only the electric motor/generator is used to transmit power to or receive power from a hydraulic pump.

Turning to FIG. 9, a schematic of the electro-hydrostatic (EHA) mode shown in FIG. 7 is depicted. The hydraulic actuation system 100 is operable in the EHA mode in which the first and second hydraulic flow paths 116, 118 are closed and the third and fourth valves 136, 138 are in the first valve position. The first valve position occurs when the third hydraulic flow path 124 is open between the first actuator port 120 and the first pump port 104 and the fourth hydraulic flow path 126 is open between the second actuator port 122 and the second pump port 106.

The control system 142 can be configured to ensure uninterrupted operations in all four-quadrant operations. That is, the mode transition logic of the control system 142 allows one mode to transit to another mode smoothly.

Figure 10:
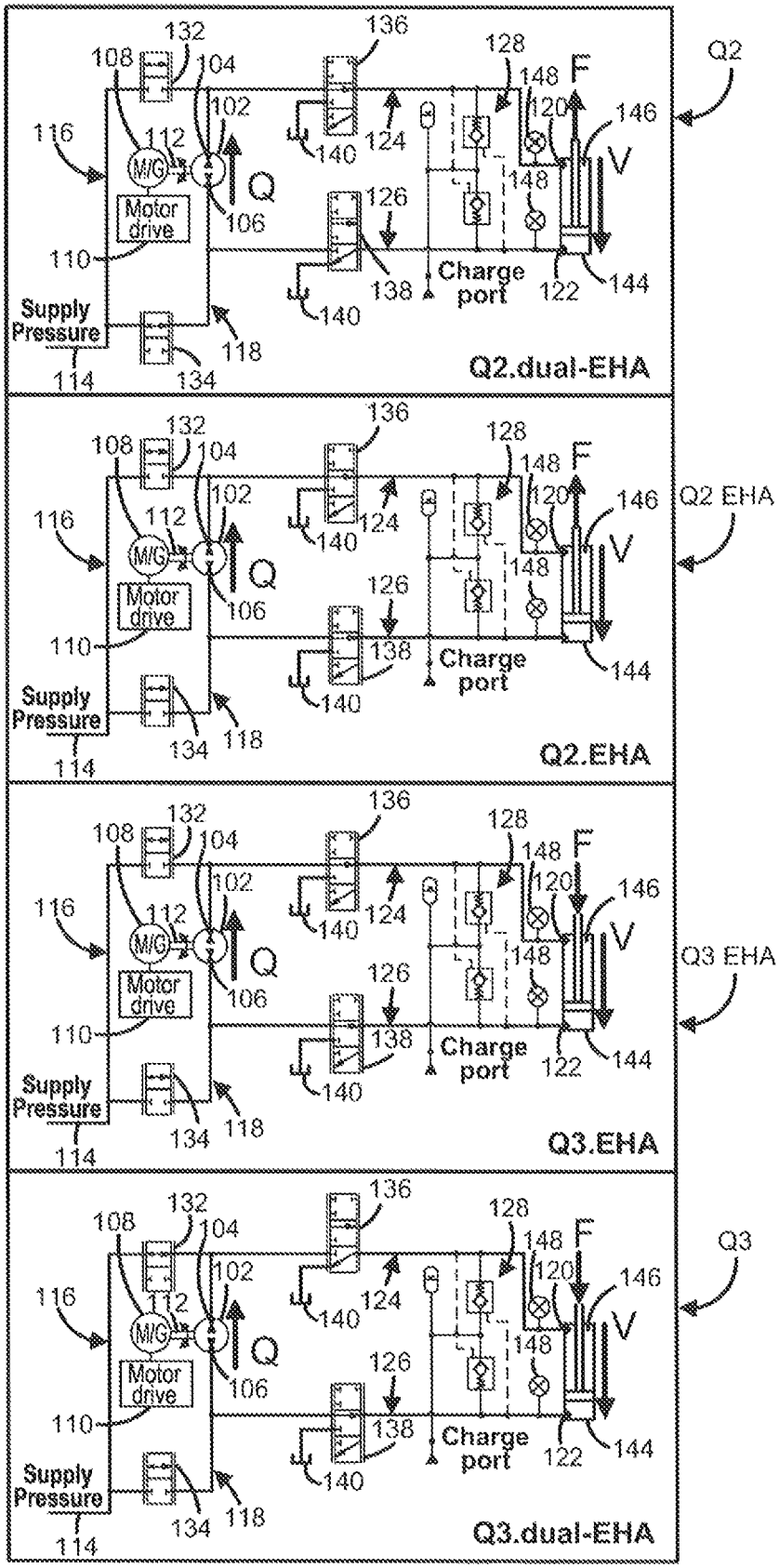
FIG. 10 schematically depicts the hydraulic actuation system of FIG. 2 transitioning between second and third quadrant operations.

FIG. 10 schematically illustrates a switching sequence between the second dual-EHA quadrant Q2 and the third dual-EHA quadrant Q3 in accordance with the principles of the present disclosure. When a load transition occurs between the second and third dual-EHA quadrants Q2, Q3, initially the hydraulic actuation system 100 is in the second dual-EHA quadrant Q2 mode for a large passive load. As the passive load decreases, the hydraulic actuation system 100 shifts into a second EHA quadrant Q2 mode, then into a third EHA quadrant Q3 mode as the load switches to overrun, and finally into the third dual-EHA quadrant Q3 mode as the overrun load becomes large. The second and third EHA quadrant Q2, Q3 modes are temporary modes in the hydraulic actuation system 100 that act as intermediate steps between transitions of the second dual-EHA quadrant Q2 to/from the third dual-EHA quadrant Q3. The second and third EHA quadrant Q2, Q3 modes allow the second dual-EHA quadrant Q2 to transit to/from the third dual-EHA quadrant Q3 and vice-versa smoothly and without interruption. Thus, the hydraulic actuation system 100 may operate without unwanted jerkiness. The transition from the third dual-EHA quadrant Q3 to the second dual-EHA quadrant Q2 is in the reverse sequence.

When a switching sequence occurs between the second dual-EHA quadrant Q2 to the second EHA quadrant Q2, the second valve 134 closes while at the same time the fourth valve 138 switches position and the supply pressure is lowered. Preferably, the second valve 134 closes and the fourth valve 138 switches position at the same time. Otherwise, if the second valve 134 closes first, the pump supply flow Q will be cut of off before the fourth valve 138 can re-connect the pump port 106 to the actuator 144. Conversely, if the fourth valve 138 switches position first, the high supply pressure could create a pressure resistance to the flow coming from the cylinder rod.

When switching from the third EHA quadrant Q3 to the third dual-EHA quadrant Q3, the supply pressure is increased to a value based on calculated load determined from pressure readings across the actuator 144 and electric-motor capacity. The first valve 132 is opened while at the same time the third valve 136 switches position. It is desired to have the first valve 132 open and the third valve 136 switch positions at the same time. Otherwise, if the first valve 132 opens first, the high supply pressure could create a pressure resistance to the flow coming from the cylinder rod.

Conversely, if the third valve 136 switches position first, the pump supply flow will be cut off before the third valve 136 re-connects the flow to the supply pressure.

Transitioning between the second EHA quadrant Q2 and the third EHA quadrant Q3 does not require any valve configuration change and is controlled through operation of the motor/generator 108.

Figure 11:
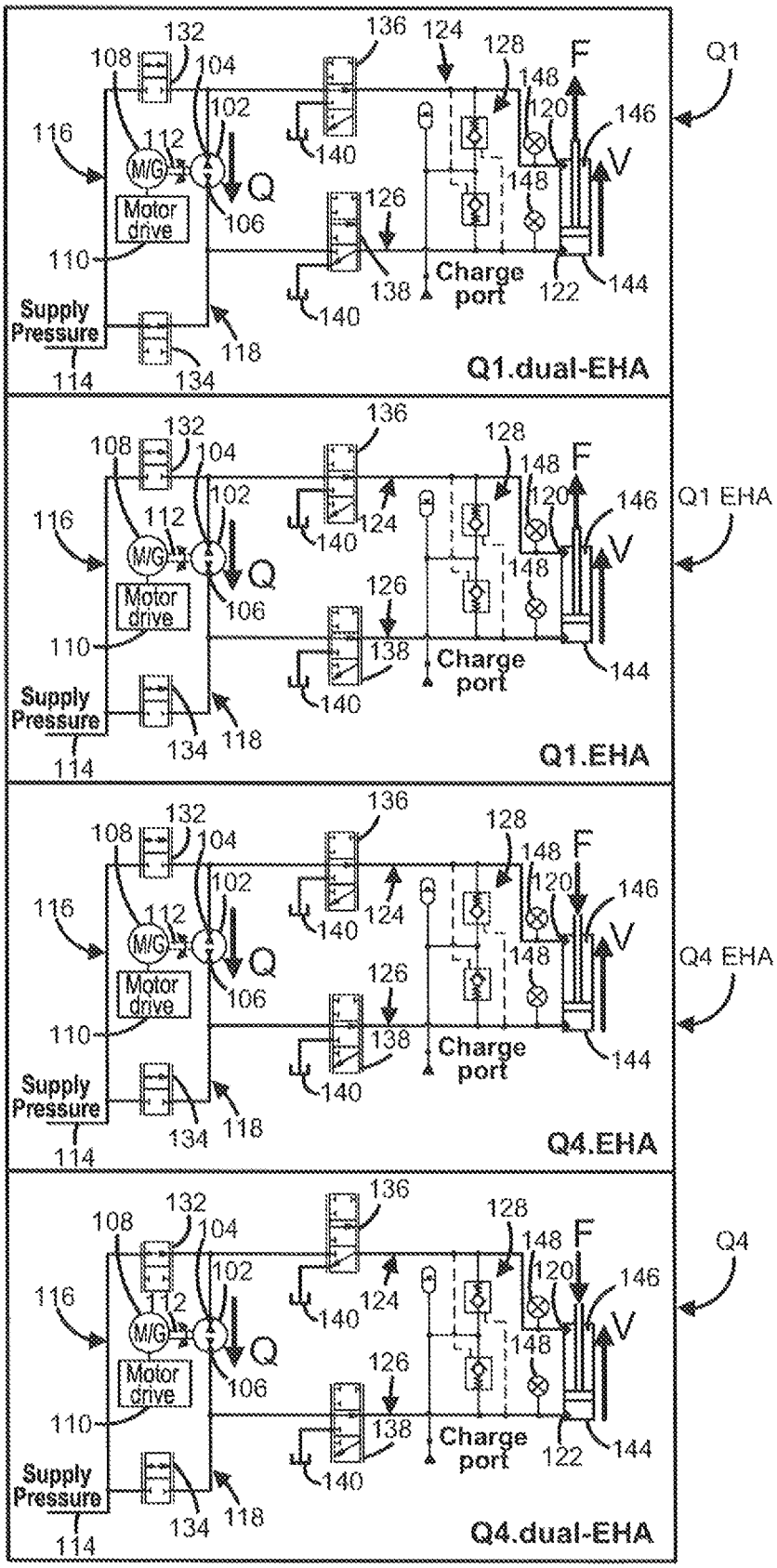
FIG. 11 schematically depicts the hydraulic actuation system of FIG. 2 transitioning between first and fourth quadrant operations.

FIG. 11 schematically illustrates a switching sequence between the first dual-EHA quadrant QI and the fourth dual-EHA quadrant Q4 in accordance with the principles of the present disclosure. When a load transition occurs between the first and fourth dual-EHA quadrants QI, Q4, initially the hydraulic actuation system 100 is in the first dual-EHA quadrant QI mode for a large overrun load. As the overrun load decreases, the hydraulic actuation system I 00 shifts into a first EHA quadrant QI mode, then into a fourth EHA quadrant Q4 mode as the load switches to passive, and finally into the fourth dual-EHA quadrant Q4 mode as the passive load becomes large. The first and fourth EHA quadrant Q1, Q4 modes are temporary modes in the hydraulic actuation system I 00 that act as intermediate steps between transitions of the first dual-EHA quadrant QI to/from the fourth dual-EHA quadrant Q4. The first and fourth EHA quadrant QI, Q4 modes allow the first dual-EHA quadrant QI to transit to/from the fourth dual-EHA quadrant Q4 and vice-versa smoothly and without interruption. Thus, the hydraulic actuation system I 00 may operate without unwanted jerkiness.

Valve positions for the first dual-EHA quadrant QI (overrun load) and the second dual-EHA quadrant Q2 (passive load) are the same, allowing mode transition without valve synchronization for large loads. This also applies for the third dual-EHA quadrant Q3 and the fourth dual-EHA quadrant Q4.

Any of the dual-EHA or EHA operating modes may be transitioned to load-holding mode in accordance with the principles of the present disclosure.

Referring again to FIG. 7, the dual-EHA mode can be switched to/from the load-holding mode. Although the transition is shown between the fourth dual-EHA quadrant Q4 and the load-holding mode, a similar strategy may also be used when transitioning from the first, second, and third dual-EHA quadrants QI, Q2, Q3 to the load-holding mode.

When a switching sequence occurs from the fourth dual-EHA quadrant Q4 to the load-holding mode, the control system 142 may synchronically close the third and fourth valves 136, 138 and de-actuate the electric motor/generator 108 in the system. Next, supply pressure from the hydraulic pressure source 114 may be lowered while at the same time opening the second valve 134 to relieve high pressures across the bi-directional hydraulic pump 102. Thus, the load can be held by the third and fourth valves 136, 138. The same valve configuration would apply for the third dual-EHA quadrant Q3 but with the velocity arrow V changing direction.

In certain examples, the hydraulic actuation system 100 may be operated temporarily in the electro-hydrostatic mode (EHA mode) as an intermediate step that takes place as the hydraulic actuation system 100 is switched between the dual-EHA mode to/from the load-holding mode to allow for a smooth and uninterrupted transition.

When the hydraulic actuation system 100 is switched from the load-holding mode to the dual-EHA mode, the second valve 134 closes to prevent flow re-circulating back to supply pressure provided by the hydraulic pressure source 114. The supply pressure may be increased to a value based on load force from pressure readings across the actuator 144 and electric-motor capacity. The supply pressure may be increased to avoid load-falling or stalling of the electric motor/generator 108 at high torque when the third and fourth valves 136, 138 open. The electric motor/generator 108 may be actuated to increase inlet pressure and match cylinder load. The opening of the third and fourth valves 136, 138 may be synchronized to move the cylinder.

The EHA mode may also be switched to/from load holding mode in accordance with the principles of the present disclosure. When a switching sequence occurs from the EHA mode to the load-holding mode, the control system 142 may synchronize the closing of the third and fourth valves 136, 138 and de-activate the electric motor/generator 108. The first and second valves 132, 134 may be opened to relieve the high pressures across the bi-directional hydraulic pump 102. Thus, the load can be held by the third and fourth valves 136, 138.

When the hydraulic actuation system 100 is switched from the load-holding mode to the EHA mode, the first and second valves 132, 134 may be closed to prevent flow from re-circulating back to the hydraulic pressure source 114 and the electric motor can be actuated to increase inlet pressure and match cylinder load based on pressure readings across the actuator 144. The control system 142 may synchronize the opening of the third and fourth valves 136, 138 while also closing the first and second valves 132, 134 to move the actuator 144.

Figure 12:
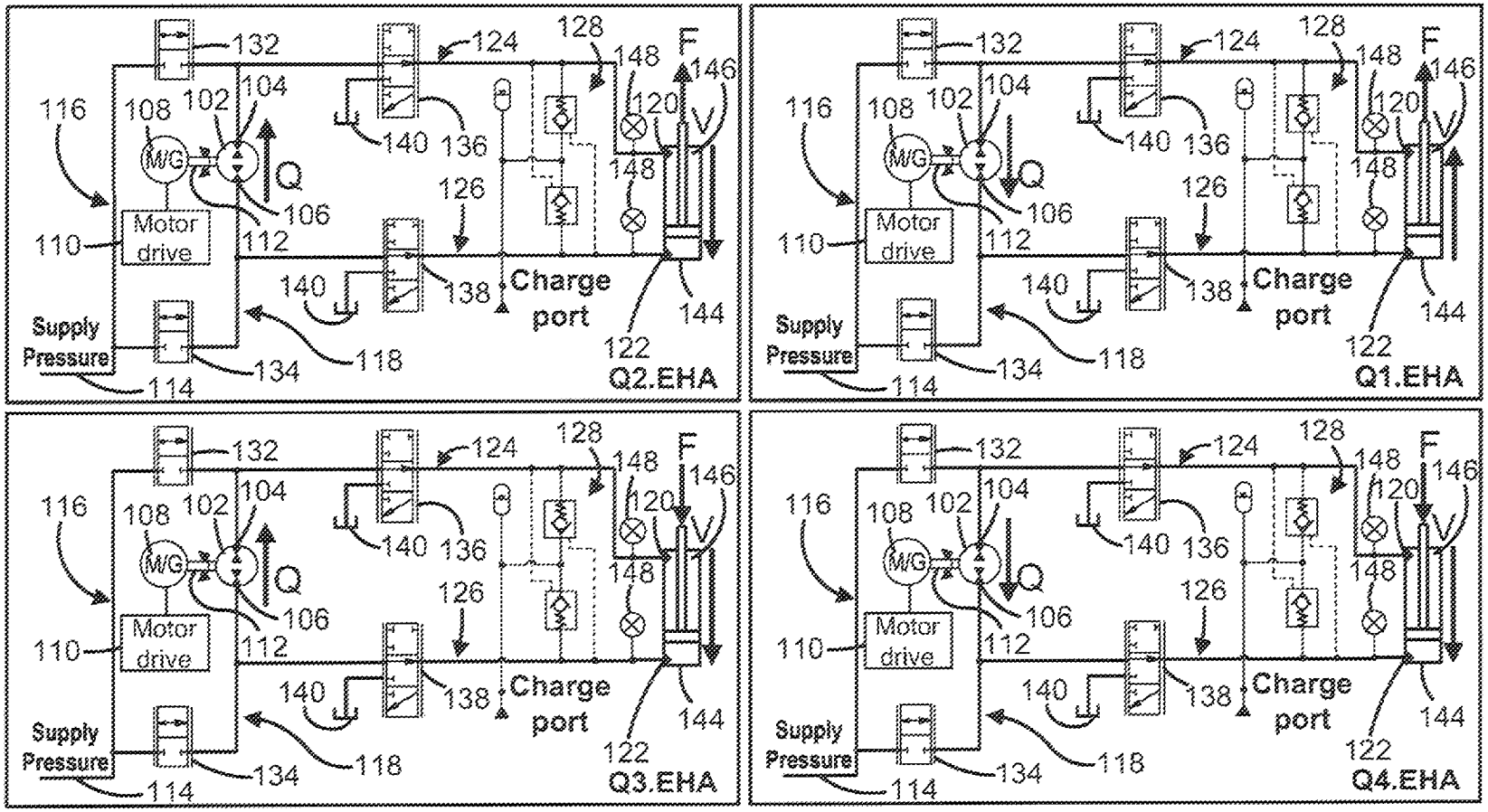
FIG. 12 schematically depicts four quadrant operations of electro-hydraulic modes temporarily used in the hydraulic actuation system as intermediate steps that take place when transitioning from the different dual hydraulic and electro-hydrostatic modes in accordance with the principles of the present disclosure.
Figure 13:
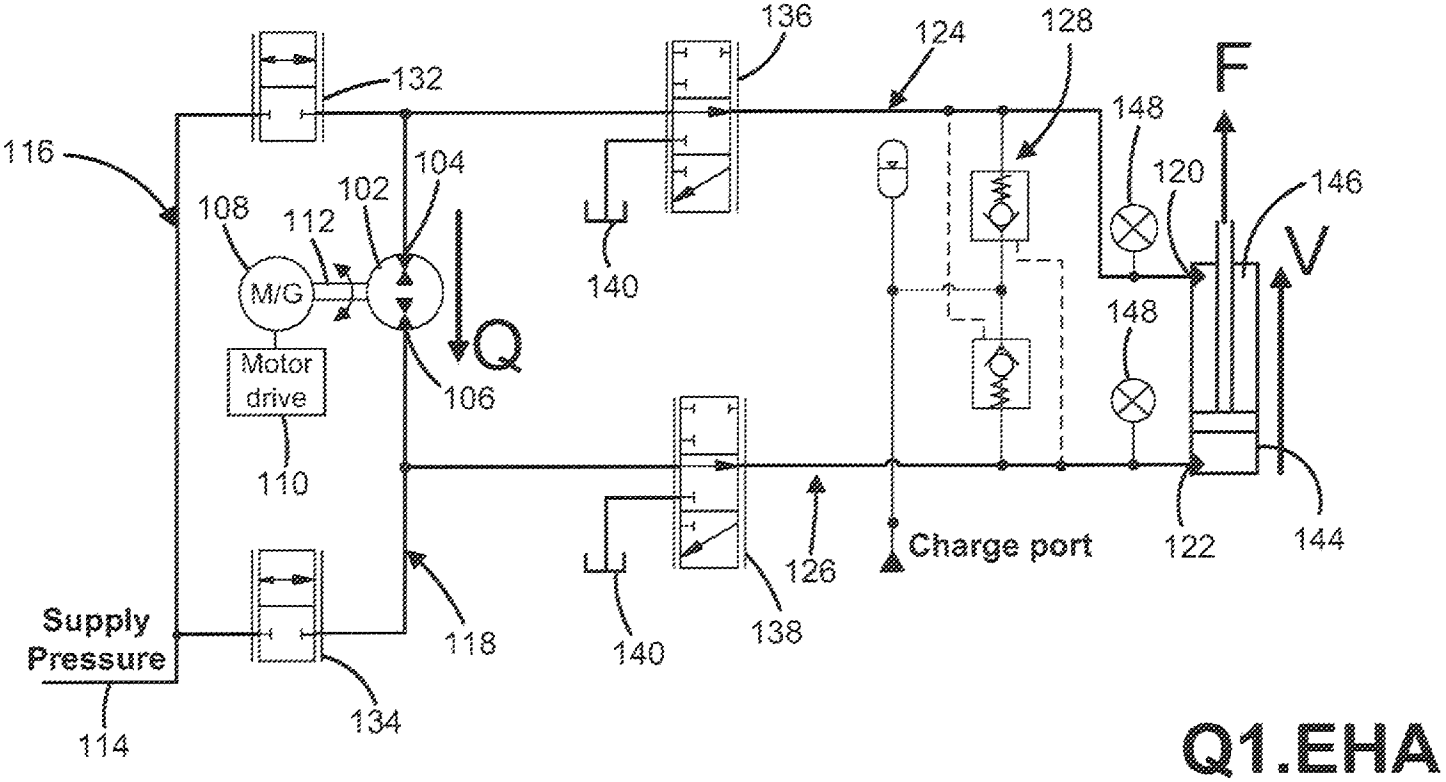
FIG. 13 schematically depicts a first over-running EHA operating condition corresponding to first quadrant operation.
Figure 14:
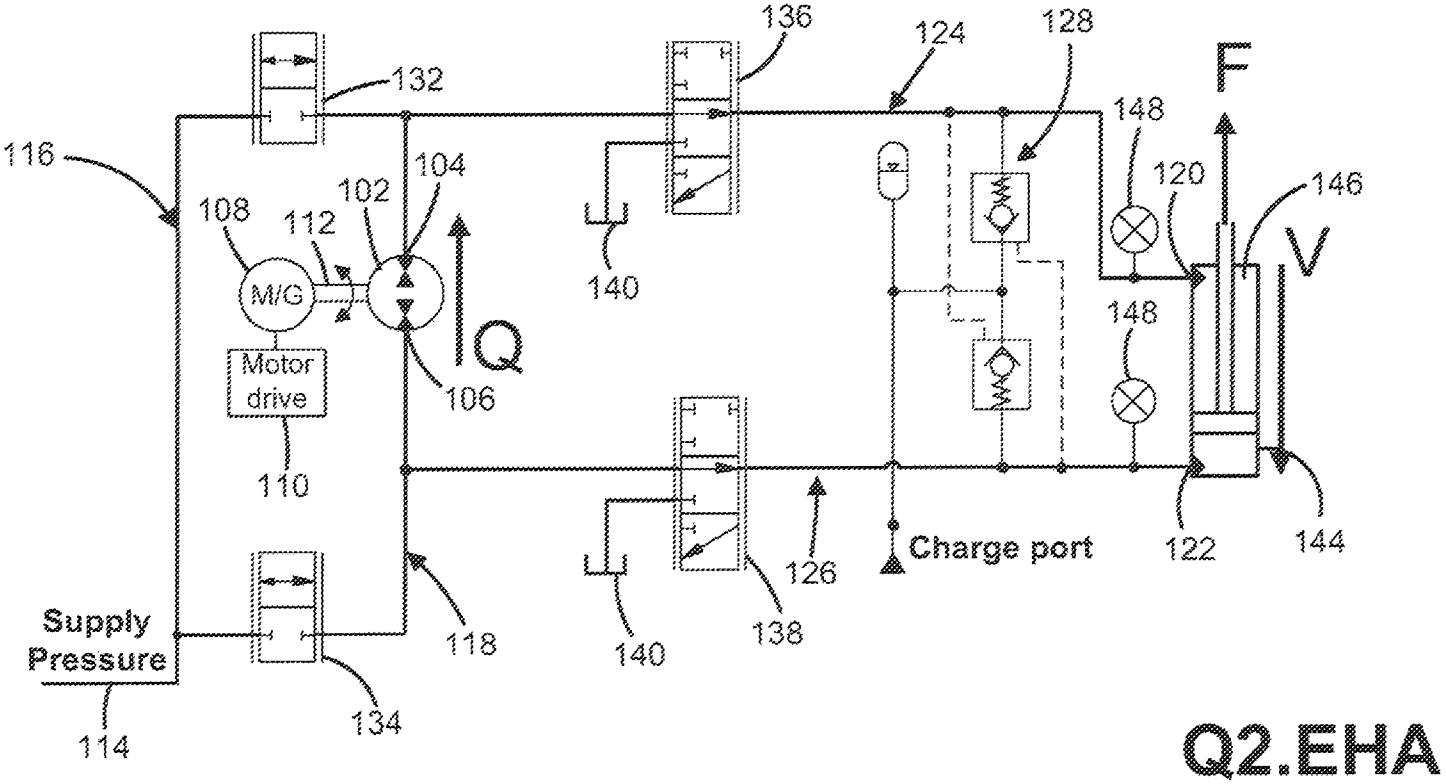
FIG. 14 schematically depicts a first passive EHA operating condition corresponding to second quadrant operation.
Figure 15:
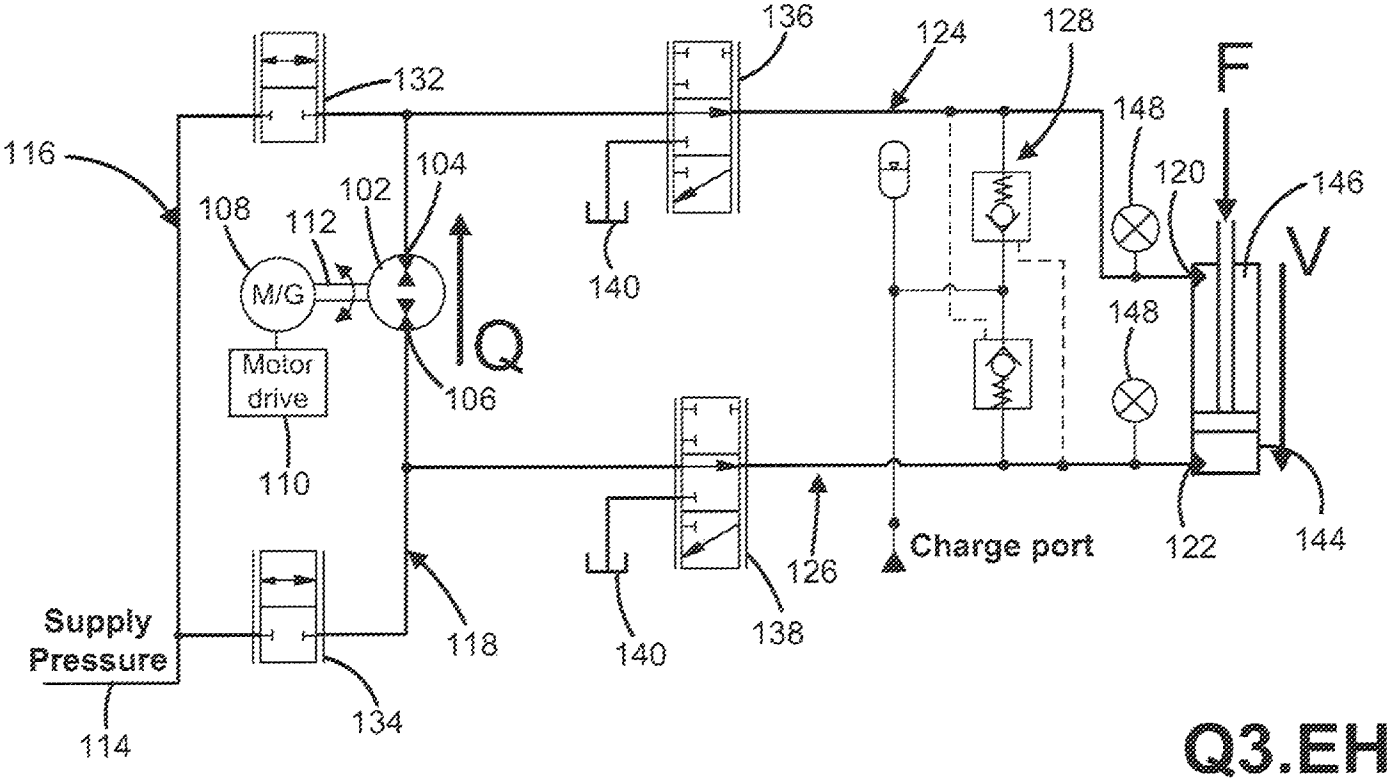
FIG. 15 schematically depicts a second over-running EHA operating condition corresponding to third quadrant operation.
Figure 16:
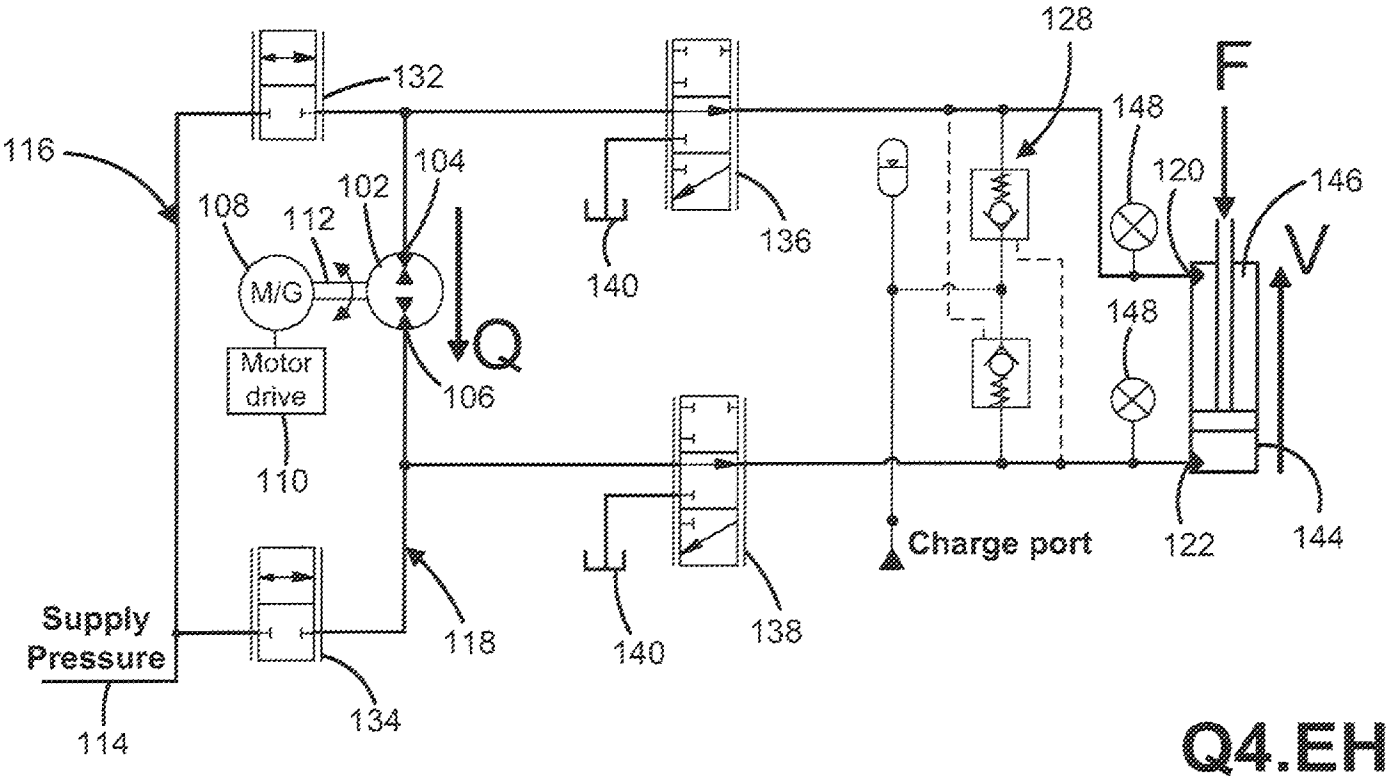
FIG. 16 schematically depicts a second passive EHA operating condition corresponding to fourth quadrant operation.

Referring to FIG. 12, the four EHA quadrant modes Q1-Q4 are schematically illustrated. The valve positions for all EHA modes in all four quadrants may be the same, thus allowing mode transitions without valve synchronization between EHA modes for small loads. The second and fourth EHA quadrants Q2, Q4 are passive operating conditions in which the motor/generator 108 functions as a motor and drives the pump 102 to provide energy in the system. The pump 102 is driven in an opposite direction in the second EHA quadrant Q2 as compared to the fourth EHA quadrant Q4.

The first and third EHA quadrants QI, Q3 are over-running operating conditions in which the motor/generator I 08 functions as a generator and is driven by the pump 102. Energy is received from the weight of the load encountered such that energy can be transferred back to the generator. FIGS. 13-16 schematically illustrate the EHA quadrant modes Q1-Q4, respectively.

In the first EHA quadrant Q1, the arrow F is directed in an upward direction and the velocity arrow V is also directed in an upward direction. That is, the first EHA quadrant QI represents an operational condition in which the load force F acting on the piston rod of the actuator 144 is positive and the velocity V of the piston rod is positive.

In the second EHA quadrant Q2, the arrow F is directed in an upward direction and the velocity arrow V is in a downward direction. That is, the second EHA quadrant Q2 represents an operational condition in which the load force F acting on the piston rod of the actuator 144 is positive and the velocity V of the piston rod is negative.

In the third EHA quadrant Q3, the arrow F is directed in a downward direction and the velocity arrow V is in a downward direction. That is, the third EHA quadrant Q3 represents an operational condition in which the load force F acting on the piston rod of the actuator 144 is negative and the velocity V of the piston rod is also negative.

In the fourth EHA quadrant Q4, the arrow F is directed in a downward direction and the velocity arrow V is directed in an upward direction. That is, the fourth EHA quadrant Q4 represents an operational condition in which the load force F acting on the piston rod of the actuator 144 is negative and the velocity V of the piston rod is positive.

It will be appreciated that the symmetric architecture connecting the cylinder-rod to supply pressure and cylinder-head to supply pressure allows the same valve synchronization strategies to be re-used in different operating quadrants.

It will be appreciated that for any of the example dual power electro-hydraulic motion control units in accordance with the principles of the present disclosure, such units can be operated to control movement of the corresponding actuator (e.g., hydraulic cylinder) regardless of whether the actuator is being passively driven or is experiencing an over-running condition. When the actuator is being driven passively, energy is transferred from the bi-directional hydraulic pump to the actuator. The power can be derived from a source of hydraulic power that is transferred through a hydraulic pump/motor, or by power applied to the hydraulic pump/motor by an electric motor/generator, or by blended power provided by both the source of hydraulic power and the electric motor/generator. By operating the electric motor/generator as a motor, the electric motor/generator can be used to boost power provided to the hydraulic actuator by the hydraulic power source. By operating the electric motor/generator as a generator, the electric motor can be used to reduce the power provided to the hydraulic actuator by the hydraulic power source. When the actuator is experiencing an over-running condition, energy can be transferred from the actuator back to the bi-directional hydraulic pump. Such energy can be captured and stored by operating the electric motor/generator as a generator such that hydraulic energy can be converted to electrical energy which may be stored at a battery or like structure, or can be stored as hydraulic energy within an accumulator that may correspond to the source of hydraulic power (e.g., a common pressure rail).

The various examples described above are provided by way of illustration only and should not be construed to limit the scope of the present disclosure. Those skilled in the art will readily recognize various modifications and changes that may be made without following the example examples and applications illustrated and described herein, and without departing from the true spirit and scope of the present disclosure.

What is claimed is:

1. A hydraulic system comprising:

a bi-directional hydraulic pump having a first pump port and a second pump port;

an electric motor/generator mechanically coupled to the hydraulic pump; a hydraulic pressure source;

a first actuator port and a second actuator port;

a valve arrangement configured for operating the hydraulic system in a plurality of modes including:

A) a first combined hydraulic and electro-hydrostatic mode in which: a) the first pump port is fluidly connected to the first actuator port; b) the second pump port is fluidly connected to the hydraulic pressure source; and c) the second actuator port is fluidly connected to tank;

B) a second combined hydraulic and electro-hydrostatic mode in which:

a) the first pump port is fluidly connected to the hydraulic pressure source; b) the second pump port is fluidly connected to the second actuator port; and c) the first actuator port is fluidly connected to tank;

C) a load-holding mode in which: a) the hydraulic pressure source is connected to the first and second pump ports; b) the first and second actuator ports are disconnected from the first and second pump ports; and c) hydraulic fluid flow through the first and second actuator ports is locked; and D) an electro-hydrostatic mode in which the hydraulic pressure source is disconnected from the first and second pump ports, and a closed hydraulic circuit is defined between the hydraulic pump and the first and second actuator ports; and a control system for coordinating operation of the valve arrangement, the control system having a transition control protocol used for transitioning the hydraulic system between two different modes, wherein a first of the two different modes includes one of the first combined hydraulic and electro-hydrostatic mode, the second combined hydraulic and electro-hydrostatic mode or the load-holding mode, wherein a second of the two different modes includes one of the first combined hydraulic and electro-hydrostatic mode, the second combined hydraulic and electro-hydrostatic mode or the load-holding mode, and wherein the transition control protocol includes operating the hydraulic system temporarily in the electro-hydrostatic mode as an intermediate step that takes place as the hydraulic system is transitioned between the first and second combined hydraulic and electro-hydrostatic modes.

2. The hydraulic system of claim 1, wherein the control system is configured to sense a load transition condition, wherein the load transition condition is a condition in which a load applied to an actuator fluidly coupled to the first and second actuator ports is transitioning from a passive state to an over-running state and vice versa, wherein the control system uses the transition control protocol for transitioning the hydraulic system between the first and second combined hydraulic and electro-hydrostatic modes when a load transition condition is sensed, and wherein the transition control protocol includes operating the hydraulic system temporarily in the electro-hydrostatic mode as an intermediate step that takes place as the hydraulic system is transitioned from one of the first and second combined hydraulic and electro-hydrostatic modes to the other of the first and second combined hydraulic and electro-hydrostatic modes.

3. The hydraulic system of claim 2, further comprising pressure sensors for sensing pressures corresponding to the first and second actuator ports, wherein the control system uses the sensed pressures to determine when a load transition condition is occurring.

4. A hydraulic system comprising:

a bi-directional hydraulic pump having a first pump port and a second pump port;

an electric motor/generator mechanically coupled to the hydraulic pump; a hydraulic pressure source;

a first hydraulic flow path for fluidly connecting the hydraulic pressure source to the first pump port;

a first valve positioned along the first hydraulic flow path for opening the first hydraulic flow path such that fluid communication is provided between the first pump port and the hydraulic pressure source and for closing the first hydraulic flow path such that fluid communication is blocked between the hydraulic pressure source and the first pump port;

a second hydraulic flow path for fluidly connecting the hydraulic pressure source to the second pump port;

a second valve positioned along the second hydraulic flow path for opening the second hydraulic flow path such that fluid communication is provided between the second pump port and the hydraulic pressure source and for closing the second hydraulic flow path such that fluid communication is blocked between the hydraulic pressure source and the second pump port;

first and second actuator ports;

a third hydraulic flow path for fluidly connecting the first pump port to the first actuator port;

a third valve positioned along the third hydraulic flow path, the third valve having a first valve position in which the third hydraulic flow path is open between the first actuator port and the first pump port, a second valve position in which the third hydraulic flow path is blocked and flow through a portion of the third hydraulic flow path located between the third valve and the first actuator port is hydraulically locked, and a third valve position in which fluid communication between the first pump port and the first actuator port through the third hydraulic flow path is interrupted and the first actuator port is fluidly connected to tank;

a fourth hydraulic flow path for fluidly connecting the second pump port to the second actuator port;

a fourth valve positioned along the fourth hydraulic flow path, the fourth valve having a first valve position in which the fourth hydraulic flow path is open between the second actuator port and the second pump port, a second valve position in which the fourth hydraulic flow path is blocked and flow through a portion of the fourth hydraulic flow path located between the fourth valve and the second actuator port is hydraulically locked, and a third valve position in which fluid communication between the second pump port and the second actuator port through the fourth hydraulic flow path is interrupted and the second actuator port is fluidly connected to tank; and a pump charge circuit for providing pump charge flow to the third and fourth hydraulic flow paths.

5. The hydraulic system of claim 4, wherein the hydraulic system is operable in:

a) a first combined hydraulic and electro-hydrostatic mode in which the first hydraulic flow path is closed, the second hydraulic flow path is open, the third valve is in the first valve position and the fourth valve is in the third valve position; and b) a second combined hydraulic and electro-hydrostatic mode in which the second hydraulic flow path is closed, the first hydraulic flow path is open, the third valve is in the third valve position and the fourth valve is in the first valve position.

6. The hydraulic system of claim 5, wherein when the system is in the first combined hydraulic and electro-hydrostatic mode and an actuator load is passive, the electric motor/generator and the hydraulic pressure source cooperate to cause the pump to direct hydraulic fluid to the first actuator port.

7. The hydraulic system of claim 5, wherein when the system is in the first combined hydraulic and electro-hydrostatic mode and an actuator load is overrunning, the electric motor/generator and the hydraulic pressure source cooperate to cause the pump to direct hydraulic fluid to the first actuator port.

8. The hydraulic system of claim 5, wherein the hydraulic system is operable in a load-hold mode in which the first and second hydraulic flow paths are open and the third and fourth valves are in the second valve positions.

9. The hydraulic system of claim 8, wherein the hydraulic system is operable in an electro-hydrostatic mode in which the first and second hydraulic flow paths are closed and the third and fourth valves are in the first valve positions.

10. The hydraulic system of claim 9 further comprising a control system for coordinating operation of the first valve, the second valve, the third valve, the fourth valve, the hydraulic pump and the electric motor/generator, the control system having a transition control protocol used for transitioning the hydraulic system between two different modes, wherein a first of the two different modes includes one of the first combined hydraulic and electro-hydrostatic mode, the second combined hydraulic and electro-hydrostatic mode or the load-holding mode, wherein a second of the two different modes includes one of the first combined hydraulic and electro-hydrostatic mode, the second combined hydraulic and electro-hydrostatic mode or the load-holding mode, and wherein the transition control protocol includes operating the hydraulic system temporarily in the electro-hydrostatic mode as an intermediate step that takes place as the hydraulic system is transitioned between the first and second different modes.

11. The hydraulic system of claim 10, wherein the control system is configured to sense a load transition condition, wherein the load transition condition is a condition in which a load applied to an actuator fluidly coupled to the first and second actuator ports is transitioning from a passive state to an over-running state and vice versa, wherein the control system uses the transition control protocol for transitioning the hydraulic system between the first and second combined hydraulic and electro-hydrostatic modes when a load transition condition is sensed, and wherein the transition control protocol includes operating the hydraulic system temporarily in the electro-hydrostatic mode as an intermediate step that takes place as the hydraulic system is transitioned from one of the first and second combined hydraulic and electro-hydrostatic modes to the other of the first and second combined hydraulic and electro-hydrostatic modes.

12. The hydraulic system of claim 11, further comprising pressure sensors for sensing pressures corresponding to the first and second actuator ports, wherein the control system uses the sensed pressures to determine when a load transition condition is occurring.

13. The hydraulic system of claim 4, wherein the first and second valves are separate valves that are independently movable relative to one another.

14. The hydraulic system of claim 4, wherein the third and fourth valves are separate valves that are independently movable relative to one another.

* * * * *